US007894867B2

(12) United States Patent
Matthaei et al.

(10) Patent No.: US 7,894,867 B2
(45) Date of Patent: Feb. 22, 2011

(54) ZIG-ZAG ARRAY RESONATORS FOR RELATIVELY HIGH-POWER HTS APPLICATIONS

(75) Inventors: George L. Matthaei, Santa Barbara, CA (US); Balam A. Willemsen, Newbury Park, CA (US); Eric M. Prophet, Santa Barbara, CA (US); Genichi Tsuzuki, Ventura, CA (US)

(73) Assignee: Superconductor Technologies, Inc., Santa Barbara, CA (US)

( * ) Notice: Subject to any disclaimer, the term of this patent is extended or adjusted under 35 U.S.C. 154(b) by 78 days.

(21) Appl. No.: 12/118,533

(22) Filed: May 9, 2008

(65) Prior Publication Data

US 2008/0278262 A1 Nov. 13, 2008

Related U.S. Application Data

(60) Provisional application No. 60/928,530, filed on May 10, 2007.

(51) Int. Cl.
*H01P 1/203* (2006.01)
*H01B 12/02* (2006.01)

(52) U.S. Cl. ..... 505/210; 333/99 S; 333/204

(58) Field of Classification Search ..... 333/99 S, 333/204; 505/210
See application file for complete search history.

(56) References Cited

U.S. PATENT DOCUMENTS 5,922,650 A * 7/1999 Ye ..... 505/210
5,977,847 A * 11/1999 Takahashi ..... 333/204
6,026,311 A 2/2000 Willemsen Cortes et al.
6,067,461 A * 5/2000 Ye et al. ..... 505/210
6,122,533 A * 9/2000 Zhang et al. ..... 505/210
6,424,846 B1 * 7/2002 Cortes et al. ..... 505/210
7,245,196 B1 * 7/2007 Baliarda et al. ..... 333/219
2003/0222732 A1 12/2003 Mattahei
2004/0130411 A1 7/2004 Beaudin et al.

OTHER PUBLICATIONS

PCT International Search Report for PCT/US08/63316, Applicant: Superconductor Technologies, Inc., Form PCT/ISA/210 and 220, dated Aug. 15, 2008 (4 pages).

PCT Written Opinion of the International Search Authority for PCT/US08/63316, Applicant: Superconductor Technologies, Inc., Form PCT/ISA/237, dated Aug. 15, 2008 (5 pages).

PCT International Preliminary Report on Patenatbility (Chapter I of the Patent Cooperation Treaty) for PCT/US2008/063316, Applicant: Superconductor Technologies, Inc., Form PCT/IB/326 and 237, dated Nov. 10, 2009 (5 pages).

(Continued)

*Primary Examiner*—Benny Lee
(74) *Attorney, Agent, or Firm*—Vista IP Law Group LLP

(57) ABSTRACT

A narrowband filter comprises an input terminal, an output terminal, and an array of basic resonator structures coupled between the terminals to form a single resonator having a resonant frequency. The resonator array may be arranged in a plurality of columns of basic resonator structures, with each column of basic resonator structures having at least two basic resonator structures. The basic resonator structures in each column may be coupled between the terminals in parallel or in cascade. Two or more resonator arrays may be coupled to generate multi-resonator filter functions.

23 Claims, 13 Drawing Sheets

OTHER PUBLICATIONS

Shen, Zhi-Yuan et al., High Tc Superconductor-Sapphire Microwave Resonator with Extemely High Q-Values up to 90 K, IEEE Trans. Microwave Theory Tech., vol. 40, pp. 2424-2432, Dec. 1992.

Setsune, K. et al., Elliptic-Disc Filters of High-Tc Superconducting Films for Power-Handling Capability Over 100 W, IEEE Trans. Microwave Theory Tech., vol. 48, pp. 1256-1264, Jul. 2000.

Yeo, K.S.K. et al., 5-Pole High-Temperature Superconducting Bandpass Filter at 12 GHZ Using High Power TM010 Mode of Microstrip Circular Patch,, Microwave Conference, 2000 Asia-Pacific, pp. 596-599, 2000.

Matthaei, George L., Narrow-Band, Fixed-Tuned and Tunable Band-Pass Filters with Zig-Zag, Hairpin-Comb Resonators, IEEE Trans. Microwave Theory-Tech, vol. 51, pp. 1214-1219, Apr. 2003.

U.S. Appl. No. 61/070,634, Micro-Miniature Monolithic Electromagnetic Resonators, Inventor: Eric M. Prophet, et al., filed Mar. 25, 2005.

U.S. Appl. No. 12/410,976, Micro-Miniature Monolithic Electromagnetic Resonators, Inventor: Eric M. Prophet, et al., filed Mar. 25, 2009.

* cited by examiner

ZIG-ZAG ARRAY RESONATORS FOR RELATIVELY HIGH-POWER HTS APPLICATIONS

RELATED APPLICATION

This application claims priority from U.S. Provisional Patent Application Ser. No. 60/928,530, filed May 10, 2007, which is expressly incorporated herein by reference.

FIELD OF THE INVENTION

The present inventions generally relate to microwave filters, and more particularly, to microwave filters designed for narrow-band applications.

BACKGROUND OF THE INVENTION

Electrical filters have long been used in the processing of electrical signals. In particular, such electrical filters are used to select desired electrical signal frequencies from an input signal by passing the desired signal frequencies, while blocking or attenuating other undesirable electrical signal frequencies. Filters may be classified in some general categories that include low-pass filters, high-pass filters, band-pass filters, and band-stop filters, indicative of the type of frequencies that are selectively passed by the filter. Further, filters can be classified by type, such as Butterworth, Chebyshev, Inverse Chebyshev, and Elliptic, indicative of the type of bandshape frequency response (frequency cutoff characteristics) the filter provides relative to the ideal frequency response.

The type of filter used often depends upon the intended use. In communications applications, band-pass filters are conventionally used in cellular base stations and other telecommunications equipment to filter out or block RF signals in all but one or more predefined bands. For example, such filters are typically used in a receiver front-end to filter out noise and other unwanted signals that would harm components of the receiver in the base station or telecommunications equipment. Placing a sharply defined band-pass filter directly at the receiver antenna input will often eliminate various adverse effects resulting from strong interfering signals at frequencies near the desired signal frequency. Because of the location of the filter at the receiver antenna input, the insertion loss must be very low so as to not degrade the noise figure. In most filter technologies, achieving a low insertion loss requires a corresponding compromise in filter steepness or selectivity.

In commercial telecommunications applications, it is often desirable to filter out the smallest possible pass-band using narrow-band filters to enable a fixed frequency spectrum to be divided into the largest possible number of frequency bands, thereby increasing the actual number of users capable of being fit in the fixed spectrum. With the dramatic rise in wireless communications, such filtering should provide high degrees of both selectivity (the ability to distinguish between signals separated by small frequency differences) and sensitivity (the ability to receive weak signals) in an increasingly hostile frequency spectrum. Of most particular importance is the frequency range from approximately 800-2,200 MHz. In the United States, the 800-900 MHz range is used for analog cellular communications. Personal communication services (PCS) are used in the 1,800 to 2,200 MHz range.

Microwave filters are generally built using two circuit building blocks: a plurality of resonators, which store energy very efficiently at one frequency, $f_0$; and couplings, which couple electromagnetic energy between the resonators to form multiple stages or poles. For example, a four-pole filter may include four resonators. The strength of a given coupling is determined by its reactance (i.e., inductance and/or capacitance). The relative strengths of the couplings determine the filter shape, and the topology of the couplings determines whether the filter performs a band-pass or a band-stop function. The resonant frequency $f_0$ is largely determined by the inductance and capacitance of the respective resonator. For conventional filter designs, the frequency at which the filter is active is determined by the resonant frequencies of the resonators that make up the filter. Each resonator must have very low internal resistance to enable the response of the filter to be sharp and highly selective for the reasons discussed above. This requirement for low resistance tends to drive the size and cost of the resonators for a given technology.

Historically, filters have been fabricated using normal; that is, non-superconducting conductors. These conductors have inherent lossiness, and as a result, the circuits formed from them have varying degrees of loss. For resonant circuits, the loss is particularly critical. The quality factor (Q) of a device is a measure of its power dissipation or lossiness. For example, a resonator with a higher Q has less loss. Resonant circuits fabricated from normal metals in a microstrip or stripline configuration typically have Q's at best on the order of four hundred.

With the discovery of high temperature superconductivity in 1986, attempts have been made to fabricate electrical devices from high temperature superconductor (HTS) materials. The microwave properties of HTS's have improved substantially since their discovery. Epitaxial superconductor thin films are now routinely formed and commercially available.

Currently, there are numerous applications where microstrip narrow-band filters that are as small as possible are desired. This is particularly true for wireless applications where HTS technology is being used in order to obtain filters of small size with very high resonator Q's. The filters required are often quite complex with perhaps twelve or more resonators along with some cross couplings. Yet the available size of usable substrates is generally limited. For example, the wafers available for HTS filters usually have a maximum size of only two or three inches. Hence, means for achieving filters as small as possible, while preserving high-quality performance are very desirable. In the case of narrow-band microstrip filters (e.g., bandwidths of the order of 2 percent, but more especially 1 percent or less), this size problem can become quite severe.

Though microwave structures using HTS materials are very attractive from the standpoint that they may result in relatively small filter structures having extremely low losses, they have the drawback that, once the current density reaches a certain limit, the HTS material saturates and begins to lose its low-loss properties and will introduce non-linearities. For this reason, HTS filters have been largely confined to quite low-power receive only applications. However, some work has been done with regard to applying HTS to more high-power applications. This requires using special structures in which the energy is spread out, so that a sizable amount of energy can be stored, while the boundary currents in the conductors are also spread out to keep the current densities relatively small. This, of course, means that resonator structures must be relatively large.

To our knowledge, the most high-power HTS resonator structures to date use circular disk-shaped resonators operating in a circularly symmetric mode, such as $TM_{010}$. Some use resonators consisting of a cylindrical, dielectric puck with HTS on the top and bottom surfaces (see Z-Y Shen, C. Wilker, P. Pang, W. L. Holstein, D. Face, and D. J. Kountz, "High $T_c$ Superconductor-Sapphire Microwave Resonator with Extremely High Q-Values up to 90K," *IEEE Trans. Microwave Theory Tech.*, Vol. 40, pp. 2424-2432, December 1992), while other designs just use a circular (or elliptical) disk microstrip pattern on a dielectric substrate (see K. Setsune and A. Enokihara, "Elliptic-Disc Filters of High-$T_c$ Superconductor Films for Power-Handling Capability Over 100 W," *IEEE Trans. Microwave Theory Tech.*, Vol. 48, pp. 1256-1264, July 2000; K. S. K. Yeo, M. J. Lancaster, J. S. Hong, "5-Pole High-Temperature Superconducting Bandpass Filter at 12 GHz Using High Power $TM_{010}$ Mode of Microstrip Circular Patch," *Microwave Conference,* 2000 Asia-Pacific, pp. 596-599, 2000.) In both of these approaches the desired resonance is embedded in a fairly complex spectrum of modes, and there are other resonances that can also exist at frequencies above and below the desired resonance, some of which may be quite close in frequency to the desired resonance. Unfortunately, the lowest-frequency modes tend to have strong edge current densities, which will reduce power handling and unloaded Q values, and they are also very radiative. This causes them to interact with the resonator housing (usually composed of normal metal), which will further reduce power handling and unloaded Q values. Of course, the presence of numerous, nearby resonances in the filter response is a serious problem for many practical applications where solid adjacent stop bands are required. Thus, power handling in HTS resonators is severely limited by current density saturation.

There, thus, remains a need to provide a filter resonator that exhibits a considerable increase in power handling over that of typical HTS resonators, while having minimal unwanted mode activity and achieving very high unloaded Q's.

SUMMARY OF THE INVENTION

In accordance with the present inventions, a narrowband filter comprises an input terminal, an output terminal, and an array of basic resonator structures coupled between the input terminal and the output terminal to form a single resonator having a resonant frequency (e.g., in the microwave range, such as in the range of 800-2,200 MHz). In one embodiment, the filter may further comprise another array of basic resonator structures coupled between the input terminal and the output terminal in parallel to form another single resonator having the resonant frequency. In this case, the filter will be a multi-resonator filter.

The basic resonator structures may be, e.g., planar structures, such as microstrip structures, and may be composed of a suitable material, such as a high temperature superconductor (HTS) material. Each of the basic resonator structures may have a suitable nominal length, such as a half wavelength at the resonant frequency. Each of the basic structures may be, e.g., a zig-zag structure. The single resonator may have a suitable unloaded Q, such an unloaded Q that is at least 100,000. The filter may optionally comprise at least one electrically conductive element coupled between at least two of the basic resonator structures.

The plurality of basic resonator structures may be coupled between the input terminal and the output terminal in a manner that characterizes the filter as, e.g., a band-stop filter or a band-pass filter. In one embodiment, the basic resonator structures are coupled in parallel between the input terminal and the output terminal. In this case, the plurality of basic resonator structures may comprise at least three basic resonator structures, and at least two of the basic resonator structures are coupled between the input terminal and the output terminal in cascade.

In another embodiment, the plurality of basic resonator structures comprises a plurality of columns of basic resonator structures, with each column of basic resonator structures having at least two basic resonator structures. In this case, the columns of basic resonator structures may be coupled between the input terminal and the output terminal in parallel. The basic resonator structures in each column may be coupled between the input terminal and the output terminal in parallel or in cascade.

In still another embodiment, the basic resonator array is arranged in a plurality of columns and a plurality of rows, where each of the basic resonator structures has a direction of energy propagation that is aligned with the columns. In this case, the input and output terminals may be coupled to the basic resonator array between a first pair of immediately adjacent rows, and optionally a second pair of immediately adjacent rows, or the input and output terminals may be coupled to the basic resonator array between a pair of immediately adjacent columns.

Other and further aspects and features of the invention will be evident from reading the following detailed description of the preferred embodiments, which are intended to illustrate, not limit, the invention.

BRIEF DESCRIPTION OF THE DRAWINGS

The drawings illustrate the design and utility of preferred embodiments of the present invention, in which similar elements are referred to by common reference numerals. In order to better appreciate how the above-recited and other advantages and objects of the present inventions are obtained, a more particular description of the present inventions briefly described above will be rendered by reference to specific embodiments thereof, which are illustrated in the accompanying drawings. Understanding that these drawings depict only typical embodiments of the invention and are not therefore to be considered limiting of its scope, the invention will be described and explained with additional specificity and detail through the use of the accompanying drawings in which.

DETAILED DESCRIPTION OF THE PREFERRED EMBODIMENTS

Each of the following described embodiments of filters comprises an array "basic resonators" that are connected together to create an overall resonant structure, so that the stored energy within the resonant structure is spread throughout the array of basic resonators, and the current density in any of the individual basic resonators will not be very large. As a result, the maximum current density within the resonant structure is minimized, so that the overall resonant structure has considerably higher power-handling ability than that of a basic resonator alone.

While the immediate focus herein is a relatively high-power HTS application, thereby increasing the importance of minimizing the maximum current density in the resonate structure, many of the same principles described herein would apply if the objective was to minimize the maximum electric field strength in the resonant structure. In either case, the principle is to spread the stored energy through the overall resonant structure, so that neither the current density nor the electric field strength in any of the individual basic resonators will be relatively large.

Significantly, the use of parallel and cascade connections between basic resonators yields an increase in power-handling proportional to the number of basic resonators used. Because parallel and cascade connections between the basic resonators have different characteristics with regard to introducing spurious modes, it may be desirable to use both types of connections within the resonant structure.

Though other forms of basic resonators may also be attractive, "zig-zag" resonators, which are relatively compact and tend to keep the energy confined to a region close to the surface of the substrate on which the resonators are disposed, are used in all of the embodiments described and analyzed herein. The basic zig-zag resonator structures described herein function much like ordinary half-wavelength resonators. Thus, simple, half-wavelength resonators can be used for studying the maximum currents that are expected to be found in arrays of basic resonators of this type, for a given incident power.

Figure 1A:
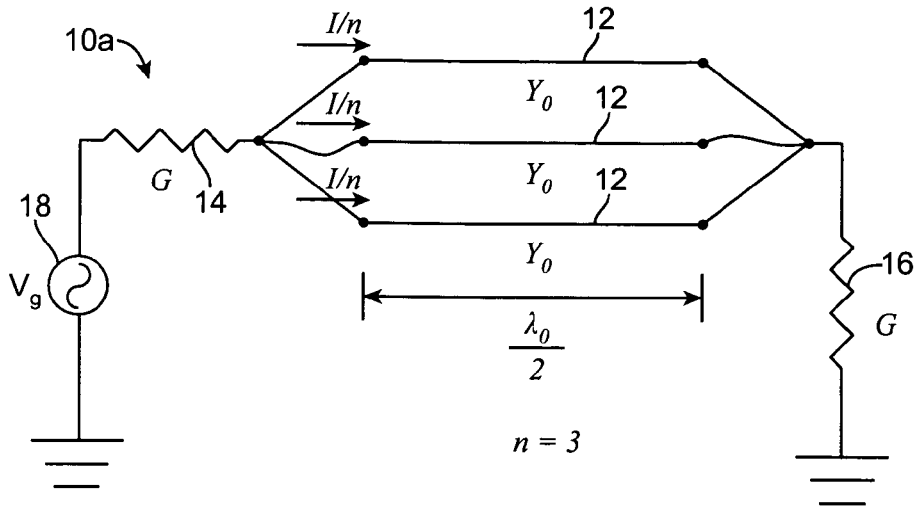
FIG. 1*a* is an electrical diagram of transmission line resonators connected in parallel to create a larger single resonator in accordance with the present inventions.
Figure 1B:
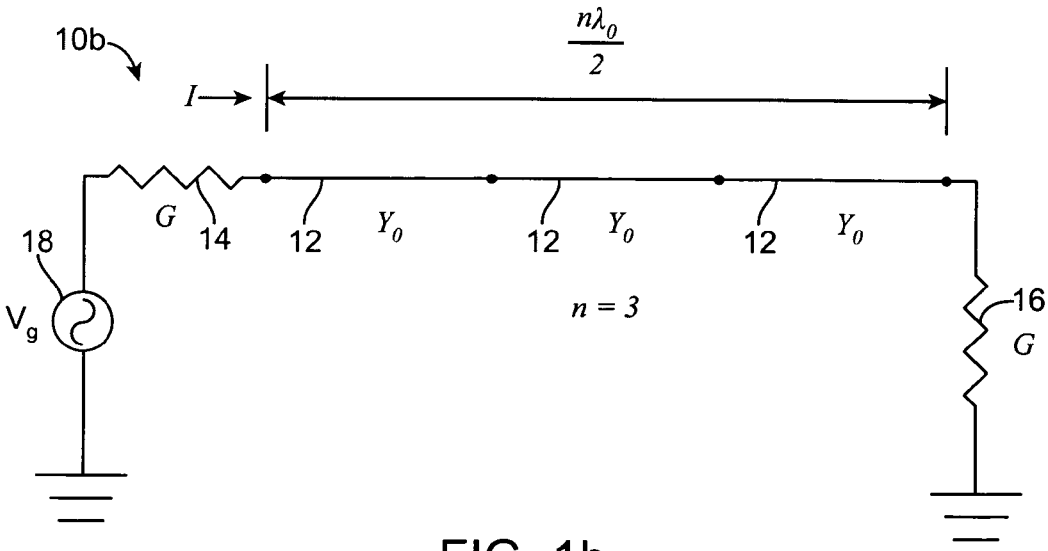
FIG. 1*b* is an electrical diagram of transmission line resonators connected in cascade to create a larger single resonator in accordance with the present inventions.

FIG. 1*a* illustrates a circuit 10*a* having an array of half-wavelength, transmission-line, resonators 12 (in this case, n=3 resonators) connected in parallel, so that a current I/n flows through each resonator 12, while FIG. 1*b* illustrates a circuit 10*b* having an array of half-wavelength, transmission-line, resonators 12 (in this case, n=3 resonators) connected in cascade, so that a current I flows through each resonator 12. Both circuits 10*a*, 10*b* comprise an input resistance termination 14, an output resistance termination 16, and a generator 18 having a source voltage $V_g$. For simplicity, the conductance G of the resistor terminations 14, 16 can be assumed to be very small compared to the characteristic admittance $Y_0$ of the resonator lines 12, though in practice, the small conductance G of the terminations 14, 16 would typically be replaced by capacitive couplings connected to 50-ohm terminations. It should be noted that for the parallel circuit 10*a*, if high precision is required, the characteristic admittance $Y_0$ for a given resonator 12 should be viewed as the characteristic admittance for that resonator line 12 as seen in the presence of the other resonator lines l2 with the same voltage applied to all. However, for simplicity, this relatively minor effect can be ignored.

The maximum currents in these two circuits 10*a*, 10*b* can be compared at a fundamental resonant frequency $f_0$ for which the resonator lines 12 are a half-wavelength ($\lambda_0/2$) long for a given external Q and for a given incident power. That is, for each of the circuits 10*a*, 10*b*, each of the n basic resonator lines and the combination of the resonator lines has the same resonant frequency. In both cases, the overall combination of n basic resonator lines 12 is seen to function as a single shunt-type resonator.

The resonator susceptance slope parameter b in the parallel circuit 10*a* of FIG. 1*a* is simply n times the slope parameter for a single basic resonator line 12 at frequency $f_0$; that is, $$b=n(\pi Y_0/2). \quad [1]$$

The cascade circuit 10*b* is essentially a resonator line of n half-wavelengths ($n\lambda_0/2$) long, which, because of the increased frequency sensitivity, has the same slope parameter b as presented in equation [1] at frequency $f_0$. Thus, at this frequency, the two circuits 10*a*, 10*b* perform in exactly the same way and will have the same external Q (where the external Q is represented by $Q_e$) that is, $$Q_e=b/(2G). \quad [2]$$

Thus for a given external Q, both circuits 10*a*, 10*b* require the same conductance G, and the current at the generators will be simply $I_g=V_g(G/2)$ at the fundamental resonant frequency $f_0$.

At first, it may appear that the parallel circuit 10*a* should have a smaller maximum current, because the current at the generator 18 is divided between the n basic resonator lines 12. But this ignores the relative standing-wave ratios in the two circuits 10*a*, 10*b*. For the cascade circuit 10*b*, the standing-wave ratio at the fundamental resonant frequency $f_0$ is given by:

$$S_b=Y_0/G, \quad [3]$$

while for the parallel circuit 10*a*, the conductance G of the terminations 14, 16 is divided between n resonator lines 12, so that the standing-wave ratio on the resonator lines 12 is given by:

$$S_a = nY_0/G. \quad [4]$$

Thus, it can be seen that the electrical current division advantage in the parallel circuit 10*a* is exactly cancelled out by the increase in the standing-wave ratio on the resonator lines 12. Now, in either case, since the structure is symmetrical, the generator 18 sees a matched load at the fundamental resonant frequency $f_0$, and the generator current will be $I_g = V_g G/2$. This will be the same as the input current to the first resonator line in the cascade circuit 10*b*, while for the parallel circuit 10*a*, the input currents to the individual resonator lines will be $I_g/n$.

Thus, since the conductance G of the terminations is much less than the admittance $Y_0$ of the resonator lines 12 at the fundamental resonant frequency $f_0$, the point at which the resonator lines 12 are connected to the generator 18 will be a current minimum point on the individual resonator lines 12. For the parallel circuit 10*a*, the current minimum point will be $I_{min(a)} = I_g/n$, while for the cascade circuit 10*b*, the current minimum point will be $I_{min(b)} = I_g$. Therefore, using equations [3] and [4] for either of the circuits 10*a*, 10*b*, the current maximum is found to be:

$$I_{max(a\ or\ b)} = I_{min(a\ or\ b)} S_{(a\ or\ b)} = V_g Y_0/2. \quad [5]$$

From this, further analysis shows that, if the maximum current $I_{max}$ that can be tolerated within an array of n basic half-wavelength resonators operated with a given $Q_e$ is known, the maximum incident power that can be handled is:

[6] $P_{max} = |I_{max}|^2 n\pi/(4Y_0 Q_e)$, where in this equation, $I_{max}$ is taken to be the rms value of the maximum current within the resonator array at the fundamental resonant frequency $f_0$. It is seen that the power handling is proportional to the number n of basic resonators 12 used, and is inversely proportional to the external Q, since larger external Q values require larger standing-wave ratios on the resonators 12.

From the preceding, it can be seen that, as far as power handling goes, there is no relative advantage between parallel and cascade connections. However, the parallel circuit 10*a* has resonances at only $f_0$ and multiples thereof, while the cascade circuit 10*b* has resonances at $f_0/n$ and multiples thereof. Thus, from the standpoint of minimizing unwanted resonances, the parallel connection is very attractive. However, in practical situations, it may be desirable to use both types of connections in order to make best use of the substrate space, and to prevent the intrusion of what can be referred to as "broad-structure modes" into the frequency range of interest. As will be described in further detail below, these latter modes interfere more as the number of basic resonators connected in parallel is increased. As a result, the number of basic resonators that can be connected in parallel becomes also limited by spurious response considerations.

Figure 2A:
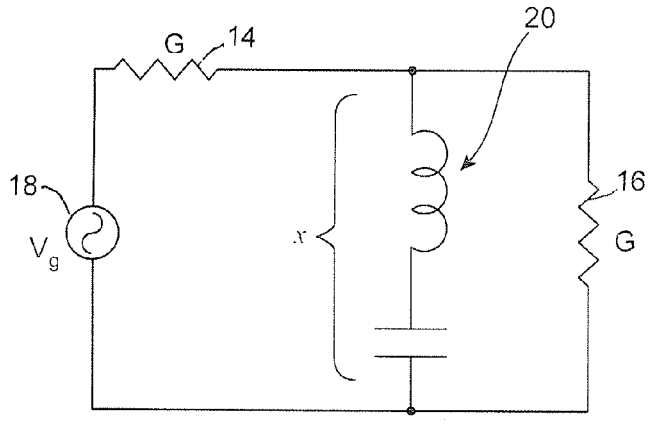
FIG. 2*a* is circuit diagram of an embodiment of a single-resonator, lumped-element band-stop filter.
Figure 2B:
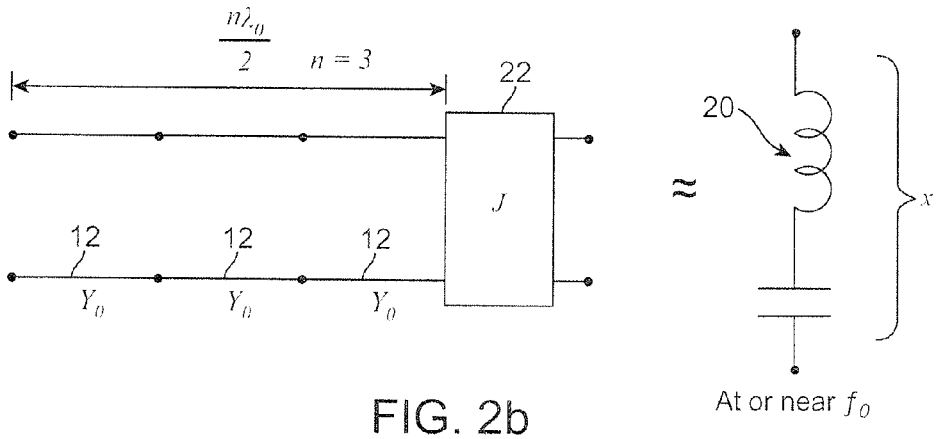
FIG. 2*b* is circuit diagram of an transmission line resonator that can be used to replace the lumped-element resonator of FIG. 2*a;*

Although the circuits 10*a*, 10*b* illustrated in F*igs*. 1*a* and 1*b* have band-pass connections, the resonator arrays may have the same power handling when used in a band-stop connection. For example, FIG. 2*a* shows a series-type, lumped-element resonator 20 in a band-stop connection, where at the fundamental resonant frequency $f_0$, transmission is shorted out, thereby providing the stop-band center. The series-resonant branch in FIG. 2*a* can be approximated by connecting either of the array resonators 12 in the circuits 10*a*, 10*b* of F*igs*. 1*a* and 1*b* through a J-inverter 22 (usually consisting of a series-capacitance coupling) as shown in FIG. 2*b*, where the resulting resonator reactance slope parameter is:

$$x = n\pi Y_0/(2J^2). \quad [7]$$

Analysis of the structure in FIG. 2*a* using the result in equation [7] gives the same equation as in equation [6], where in this case, the external Q is defined as the stop-band center frequency $f_0$ divided by the 3-dB bandwidth of the stop band. This result is what one would tend to expect if the problem is looked at from an energy point of view.

Figure 3:
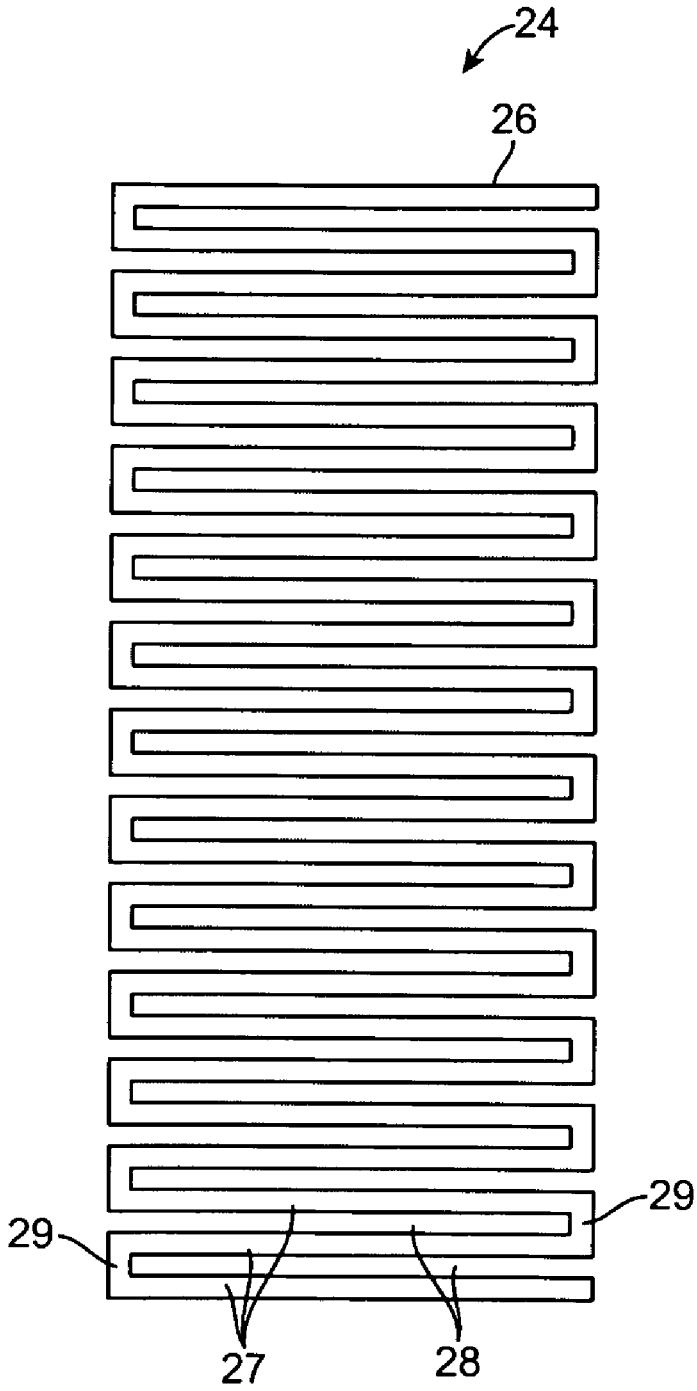
FIG. 3 is a plan view of a basic zig-zag resonator structure that can be used in many of the filters of the present inventions.

Though the analysis of the circuits illustrated in F*igs*. 1*a*, 1*b*, 2*a*, and 2*b* based on uniform transmission-line resonators does not apply exactly in all details to arrays using zig-zag resonator structures, such analysis correctly reveals the fundamentals involved. FIG. 3 illustrates a half-wave length zig-zag resonator structure 24 that can be used as a basic resonator in the embodiments described herein. The zig-zag resonator structure 24 comprises a nominally one-half wavelength resonator line 26 at the resonant frequency. The resonator line 26 is folded into a zig-zag configuration that has a plurality of parallel runs 27 with spacings 28 therebetween, with each pair of neighboring runs 27 connected together via a turn 29. Various designs of zig-zag resonator structures, as well as other types of folded linear resonators (e.q., spiral in, spiral out resonators, spiral snake resonators, etc.), that can be used herein are described in U.S. Pat. No. 6,026,311 and U.S. Provisional Patent Application Ser. No. 61/070,634, entitled "Micro-Miniature Monolithic Electromagnetic Resonators," which are expressly incorporated herein by reference.

The zig-zag resonator structure 24 has some useful properties (though not all) of the zig-zag hairpin resonators (see G. L. Matthaei, "Narrow-Band, Fixed-Tuned, and Tunable Bandpass Filters With Zig-Zag Hairpin-Comb Resonators, *IEEE Trans Microwave Theory Tech*., vol. 51, pp. 1214-1219, April 2003). One property is that these types of resonators are relatively small. Another property is that these resonators have relatively little coupling to adjacent resonators of the same type, which makes them particularly useful for narrow-band filters. A very important property for the present purposes is that for zig-zag resonator structures, the magnetic fields tend to cancel above the resonator, and, as a result, the fields are confined to the region relatively close to the surface of the resonator structure. This prevents the fields above HTS resonators from interacting with the normal-metal housing even though the overall resonator array may be quite large compared to the height of the lid on housing. By comparison, large microstrip disk resonators are much more likely to have their unloaded Q degraded due to interaction with the housing (in the case of some modes the resonator can operate like a microstrip patch antenna). In tests on zig-zag array resonators that have been performed so far, using Yttrium Barium Cuprate YBCO superconductor material on Magnesium Oxide (MgO) substrates operating at 77° K around 850 MHz, unloaded Q's well in excess of 100,000 and appreciably higher Q's at lower temperatures have been observed.

Preliminary experiments on the zig-zag resonator structure 24 indicate that it can have appreciably increased power handling if larger spacings 28 are used between the parallel runs 27. However, this will increase the size of the resonator structure 24 somewhat and may cause the fields to extend further above the resonator structure 24 can cause them to interact with the housing walls, which may reduce the unloaded Q of the resonator structure 24.

For purposes of performing experiments and analyses described herein, the zig-zag resonator structure 24 was fabricated or assumed to have a substrate of 0.508-mm-thick MgO ($\epsilon_r$=9.7), and a resonator line width and spacing of both 0.201 mm. The overall dimensions of the zig-zag resonator structure 24 were 4.42 mm×10.25 mm (0.174 in.×0.404 in.).

The fundamental resonant frequency $f_0$ of the fabricated and assumed resonator structures 24 was approximately 0.85 GHz, although it may vary some from this nominal value for the various connections described herein.

Notably, the description of the following embodiments refers to arrays of basic resonator structures that are arranged in columns and rows. For the purposes of this specification, a column of basic resonator structures is defined as a plurality of resonator structures extending along a line that is parallel to the direction of energy propagation within the resonators, and a row of basic resonator structures is defined as a plurality of resonator structures extending along a line that is perpendicular to the direction of energy propagation within the resonator structures. The description of the following embodiments also refers to top, bottom, left, and right edges of the resonator arrays. In these cases, the top and bottom edges of the resonator array are oriented along a direction perpendicular to the direction of energy propagation within the basic resonator structures, whereas the left and right edges of the resonant array are oriented along a direction parallel to the direction of energy propagation within the basic resonator structures.

Figure 4:
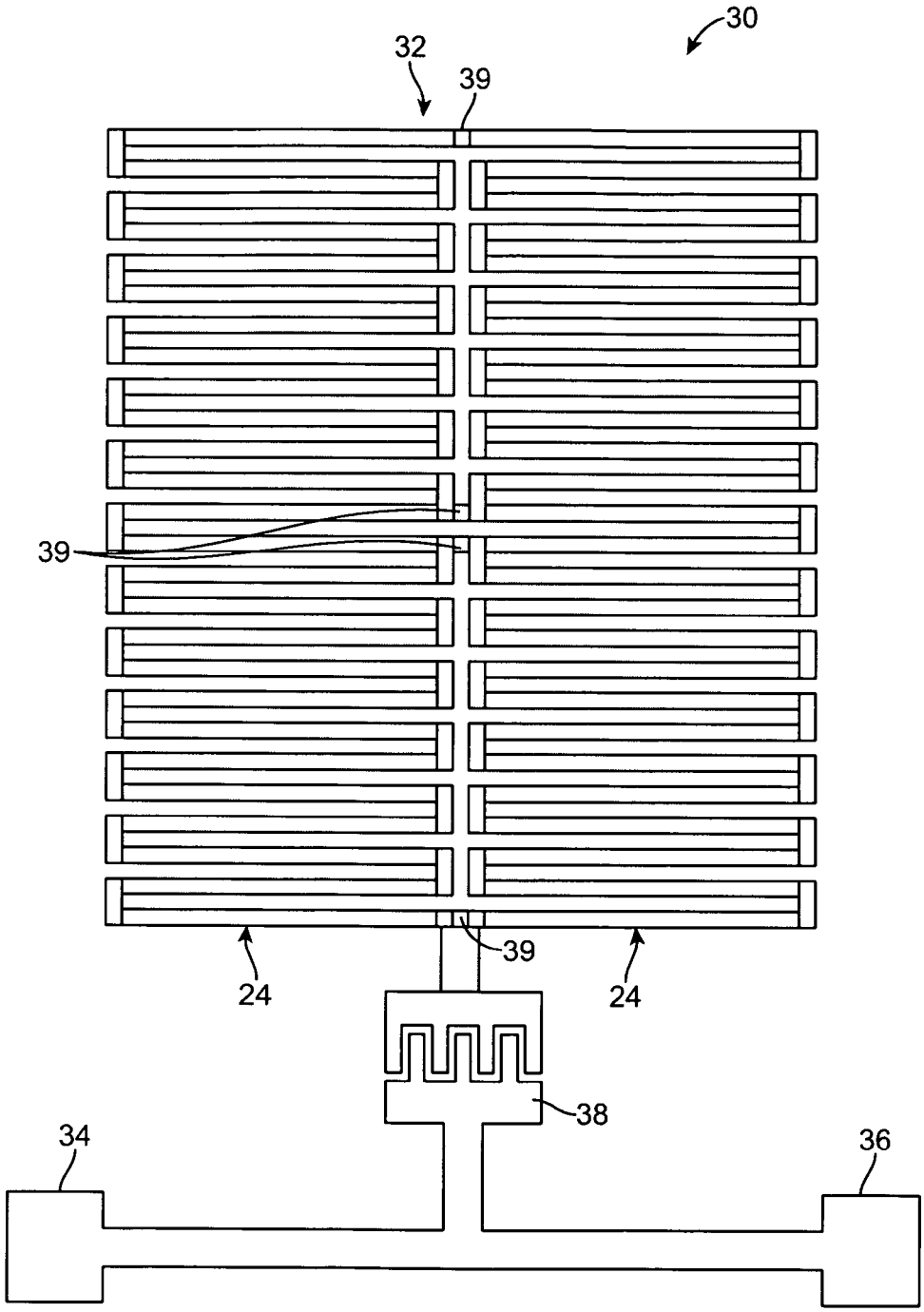
FIG. 4 is a plan view of a single-resonator, band-stop filter constructed in accordance with the present inventions.
Figure 5:
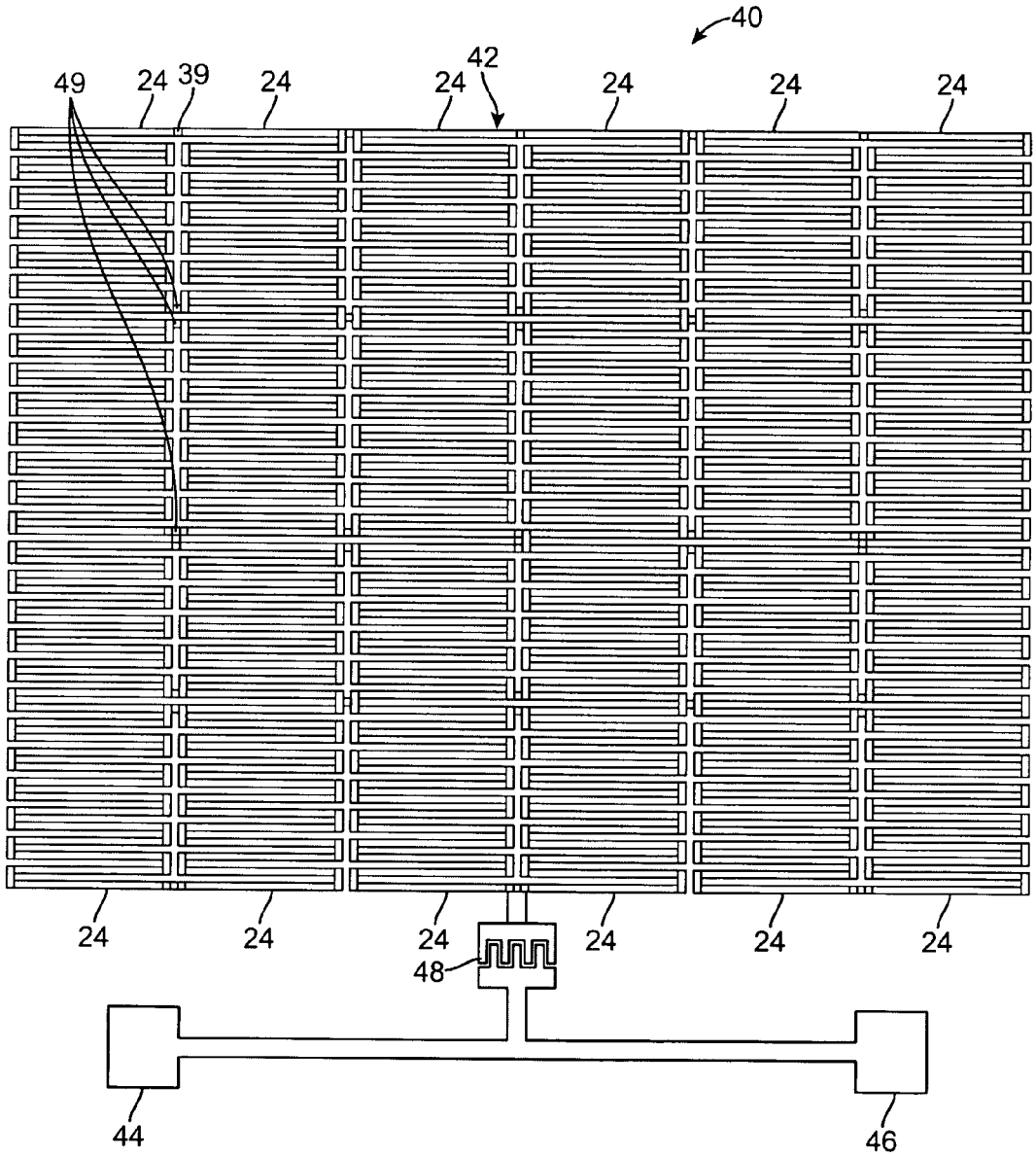
FIG. 5 is a plan view of another single-resonator, band-stop filter constructed in accordance with the present inventions.

FIG. 4 illustrates a single-resonator, band-stop filter 30 that comprises a resonator array 32 that includes two (n=2) of the basic zig-zag resonator structures 24 coupled in parallel between an input terminal 34 and an output terminal 36 via a single capacitive coupling 38. FIG. 5 illustrates a single-resonator, band-stop filter 40 that comprises a resonator array 42 that includes twelve (n=12) of the basic zig-zag resonator structures 24 arranged as six columns coupled in parallel between an input terminal 44 and an output terminal 46 via a single capacitive coupling 48, with each column including two resonator structures 24 coupled in cascade between the input and output terminals 44, 46 via the single capacitive coupling 48. In particular, the input and output terminals 44, 46 are coupled to the resonator array 42 at its bottom edge between the two innermost columns of resonator structures 24. The filter 30 should give an increase in power handling by a factor of two (3 dB) over that of a filter with a single basic resonator structure, while the filter 40 should give an increase in power handling by a factor of twelve (10.7 dB) over that of a filter with a single basic resonator structure.

It should be noted that, although the nodes at which the input and output terminals 44, 46 are connected to the resonator array 42 (in this case, the nodes at the bottom of the resonator array 42 between the six columns, and in other cases described herein, the nodes at the top, bottom, and/or middle of the array to which the terminals are coupled) are respectively separated by finite line segments (i.e., electrical energy must traverse a single zig of a zig-zag structure to get from one node to the next adjacent one), for all practical purposes, these nodes are essentially shorted together, since the length of these line segments (as compared to length of the entire line of each zig-zag structure) are much less than the wavelength at the resonant frequency.

It should be noted that the filters 30, 40 use a one-line width separation between resonator structures 24, respectively with connections 39, 49 between adjacent resonator structures 24 at the top, bottom, and midpoint of each resonator structure 24. With respect to the filter 40, the resonator structures 24 connected in cascade have their adjacent top and bottom ends butted directly against each other. Recent studies have indicated that it also works well to butt the sides of the cascaded resonator structures 24 directly against each other, so that there are no gaps at all between these resonator structures 24.

Field-solver studies were performed on the band-stop filters 30, 40 using Sonnet Software. Notably, without the connections 39, 49 at the midpoints, it was found that the filters 30, 40 had additional unwanted modes due to resonances occurring between adjacent resonator structures 24. However, the connections 39, 49 added at the midpoints of adjacent resonator structures 24 eliminated these unwanted modes and resulted in resonances equal to $f_0$ and multiples thereof.

In order to experimentally verify the principles of these techniques, four single-resonator test filters respectively having n=1, 2, 4, and 12 of the basic zig-zag resonator structures 24 were designed and fabricated, with coupling giving an external Q of approximately 1000 (a 3-dB stop-band width of 0.1 percent). In order to obtain a sensitive measurement of the power handling of the various filters for the given external Q, the filters were operated in the band-stop mode. Thus, the filters used only one coupling, as is the case with the filters 30, 40. As previously mentioned, the test filters used YBCO superconductor material on 0.508-mm-thick MgO substrates ($\in_r$=9.7).

Figure 6:
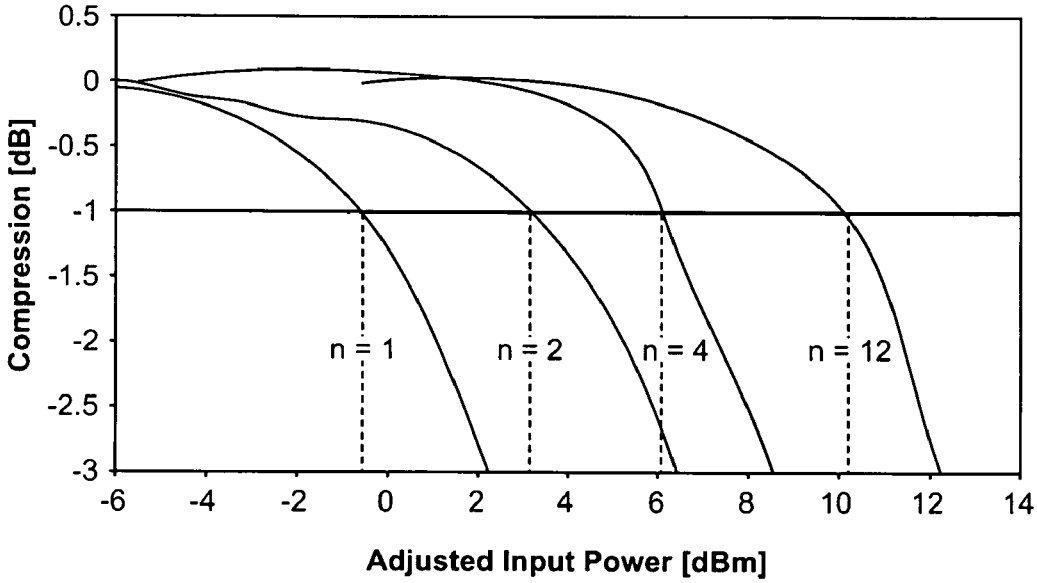
FIG. 6 is a plot of attenuation compression data measured from four HTS, single-resonator, band-stop filters constructed in accordance with the present inventions.

FIG. 6 shows the measured constant wave (CW) power-handling characteristics, and in particular the compression characteristics in dB plotted against the adjusted input power in dB, of the four filters, as measured at 77° K. The 3-dB bandwidth in all cases was 0.1 percent (external Q equals 1000), and the zero-dB level is referenced to the peak stop-band attenuation of the filters. The compression measurements indicate the deviation from maximum attenuation of the filters (of the order of 40 dB) as the input power is increased. It can be shown that if the unloaded Q is much greater than the external Q (as is the case in the test filters), the peak attenuation for a given unloaded Q (represented as $Q_u$) and external Q (represented as $Q_e$) is given by:

$$|S_{12}|_{dB}=20\log_{10}(Q_u/(2Q_e)). \quad [8]$$

Notably, as the current density begins to saturate, the unloaded Q and the peak attenuation will decrease. A 1-dB decrease in attenuation (a roughly 12 percent decrease in the unloaded Q) was arbitrarily chosen as a marker for "saturation" (i.e., the onset of nonlinearity). The measured input power values were adjusted slightly to compensate for any deviation of the measured external Q from the desired external Q of 1000. The saturation point is expected to occur at a power level 3-dB higher each time n is increased by a factor of two (as between the n=1, n=2, and n=4 cases) and by about 4.8-dB higher each time n is increased by a factor of three (as between the n=4 and n=12 cases). As can be seen from the measured data, the results are very much as expected.

It is believed that by optimizing the design of the zig-zag resonator structures 24, as described in U.S. Pat. No. 6,026,311, which was previously incorporated herein by reference, this power handling can be further improved. It should also be noted that the data in FIG. 6 are specifically for the case of $Q_e$=1000. If, for example, the same resonator structures 24 were operated as single-resonator band-pass filters with a fractional 3-dB bandwidth of 1 percent, the power handling would be 10 times as great as that shown in FIG. 6.

The unloaded Q's measured at 77° K for the n=1, 2, 4, and 12 test filters were respectively, 151,000, 120,000, 130,000, and 135,000. The corresponding unloaded Q's measured at 60° K were 220,000, 155,000, 170,000, and 240,000, respectively. These high Q's confirm that the test filters are not interacting significantly with the normal-metal housings. The measurements also confirm that the unloaded Q is not a strong function of the number of elements n, and that the variations observed arise more from variations in material quality than filter design.

Notably, Setsune, et al., which was cited above, reports on 2-resonator HTS filters with power handling over 100 W.

Although this very impressive level of power handling is orders of magnitude greater than that experienced by the test filters, it is useful to consider, at least qualitatively, possible reasons for this big difference. The response data in the test filters of FIG. 6 were generated assuming a 3-dB bandwidth of about 0.1 percent, while the response data in Setsune, et al. assumes a 3-dB bandwidth of about 1.4 percent. If the filter in Setsune, et al. had only one resonator, their 1.4 percent bandwidth would have resulted in an increase in power handling by a factor of 14 over that for a 0.1 percent bandwidth. The filter of Setsune, et al. actually had two resonators, but their advantage due to bandwidth is probably similar.

Another difference is in the definition of the measurement goals. The definition of saturation used in FIG. 6 is the 1-dB compression point in the stop-band peak attenuation of a band-stop filter, which is much more sensitive to a decline in the unloaded Q then is the definition implied in Setsune, et al. Setsune, et al. looked for a significant increase in pass-band insertion loss of a band-pass filter. For example, for a single band-pass resonator, it can be shown that the midband insertion loss will be:

$$|S_{12}|_{dB}=-20\log_{10}(1-Q_e/(Q_u)). \quad [9]$$

As has been previously mentioned, the definition of using the 1-dB compression of peak attenuation of a band-stop filter as the definition of the onset of non-linearity corresponds to about a 12 percent decrease in the unloaded Q due to the non-linearity. In the test cases of FIG. 6, the unloaded Q was over 100 times larger than the external Q, so if the filter had been used in a band-pass connection, the corresponding second term in equation [9] would be less than 0.01. Thus, it is easily seen that it would be impractical to try to detect a 12 percent change in this very small term by a band-pass insertion loss measurement. However, as can be seen from equation [8], such a measurement is quite easy using a mid-stop-band, band-stop measurement. In Setsune, et al., the onset of non-linearity is assumed to be evident when there is an appreciable increase in loss of a band-pass filter. Equation [9] does not apply exactly to the two-resonator case in Setsune, et al., but a similar principle, no doubt, does apply. When the ratio of the external Q over the unloaded Q is small, as is required for low-loss loss filters, in order to obtain a significant change in insertion loss, the unloaded Q would need to decrease a great deal in value (far more than 12 percent). The implied definition for the onset of non-linearity in Setsune, et al. is much less demanding than that which was used for obtaining the data in FIG. 6. The definition that is appropriate for practical purposes will, of course, depend on the application.

Another added factor is that the measured data in Setsune, et al. was obtained using pulsed power, while the measured data in FIG. 6 was obtained using CW power. Yet another added factor is that the measured data in Setsune, et al. was obtained at 20° K, while the measured data in FIG. 6 was obtained at 77° K. Recent tests that have been made using the definition of power saturation of FIG. 6 showed an increase in power handling of 7.3 dB when the operating temperature of the filter was reduced from 77° K to 60° K. Tests at 20° K have not been made for the test cases, but going down to that temperature would, no doubt, further increase the power handling. Notably, it should be pointed out that the experiments in Setsune, et al. were disadvantaged by the fact that the experiments were at about twice the frequency of that used in the measurements of FIG. 6. However, from the above considerations, it can be concluded that, though it is believed that the filters discussed in Setsune, et al. probably do have higher power-handling ability than do the filters associated with FIG. 6 (for example, the filters 30, 40 illustrated in FIGS. 4 and 5), it is believed that any difference is far less than it might at first seem.

In order to further understand the potentialities of zig-zag array filters, numerous extensive computer studies of various possible array designs were made. These studies involved computing frequency responses, usually over a number of octaves, in order to assess the spurious response activity of the array filters. Because of the concern that the current distributions might turn out to be very uneven (it is desired that each basic resonator contribute current equally to the array filter), which could substantially reduce the effectiveness of the techniques disclosed herein, extensive data were also obtained on the current distribution in the filters at the fundamental resonant frequency $f_0$. Surprisingly, this concern turned out to be entirely groundless, since the currents in corresponding regions of zig-zag resonator structures throughout the array filters turned out to be remarkably uniform. For example, in the largest array filter that was studied (which had n=64 basic resonators), the variation of peak current density computed for the basic zig-zag resonator structures varied less than 3 percent across the array filter, and most of that variation was at the outermost zig-zag resonator structures on each side of the array filter. This was true in all of the embodiments, which can be attributed to the fact that the zig-zag resonator structures at the edges of the array filter do not benefit as much from the mutual magnetic flux from adjacent zig-zag resonator structures, and therefore, need to have a little larger current in order to produce the needed amount of time varying magnetic flux and back voltage.

The current densities and wide-range responses of the different array filters were computed using the full-wave planar program Sonnet with cell sizes equal to the width of the transmission lines and spaces therebetween. These large size cells were often necessary due to computer memory limitations and the very large size of some of the array filters that were analyzed.

However, using these large cells had another advantage in the case of computing and displaying the relative current densities in the various regions of the array filters. This is because the current density within a microstrip line varies widely between the edges and the center of the line, and if very detailed current density data is to be obtained, it becomes difficult to compare the widely varying current densities in different regions of the array filter. However, if the cells span the line, the current density values obtained are approximately an average over the width of the line.

This makes comparison of the current densities in different regions of the array filter easier, especially in plots where the strength of the current densities in the various regions of the array filter are represented by different colors. Sonnet uses red for the most intense current densities, while, as the current weaken, the colors vary with the rainbow down to blue for the weakest current densities. As seen in grayscale, the corresponding current densities will range from a fairly dark gray for the most intense current densities down to a very light gray or white for the mid-range current densities, on to nearly black for the very low current densities. For all of the array filters discussed below, the plots will be shown with gray scale to indicate the relative current densities at the fundamental resonant frequency $f_0$ throughout the array filters.

Notably, using large cell sizes versus smaller cell sizes appeared to have virtually no effect on the shape of the broadband computed response, but did have a modest effect on the frequency scale. Using the large cells reduced the fundamental resonant frequency $f_0$ by perhaps 2.5 percent. Using large cells also had a small effect on computed bandwidth, which appeared to be negligible for the purposes of the experiments.

It should be noted that although the number n of basic resonators in the array filters described below varies widely, the maximum current density values for all of these array filters are on the order of 30 A/m. It is instructive to consider why this is. The array filters were always operated with terminations that gave an external Q of 1000 (or within a few percent of that value), while the generator voltage was always set to 1 volt. If the resonator susceptance slope parameter for a single basic resonator is b, when using an array of n such basic resonators, the overall slope parameter $b_n$ will increase by a factor of n. Then, since $Q_e=b_n/(2G)$, where G is the conductance of the terminations, it will be necessary to increase G by n in order to maintain the same external Q. Now, the available power of the generator is given by $P_{avail}=|V_g|^2G/4$, so since $V_g$ is constant, the incident power will also increase by a factor of n. If it can be assumed that the power is always divided equally amongst the basic resonators, then the power seen by each basic resonator will always be the same regardless of the value of n, and the currents in the basic resonators will always be the same. To a very large degree, that is what the results that were computed for the following filter arrays show.

Figure 7A:
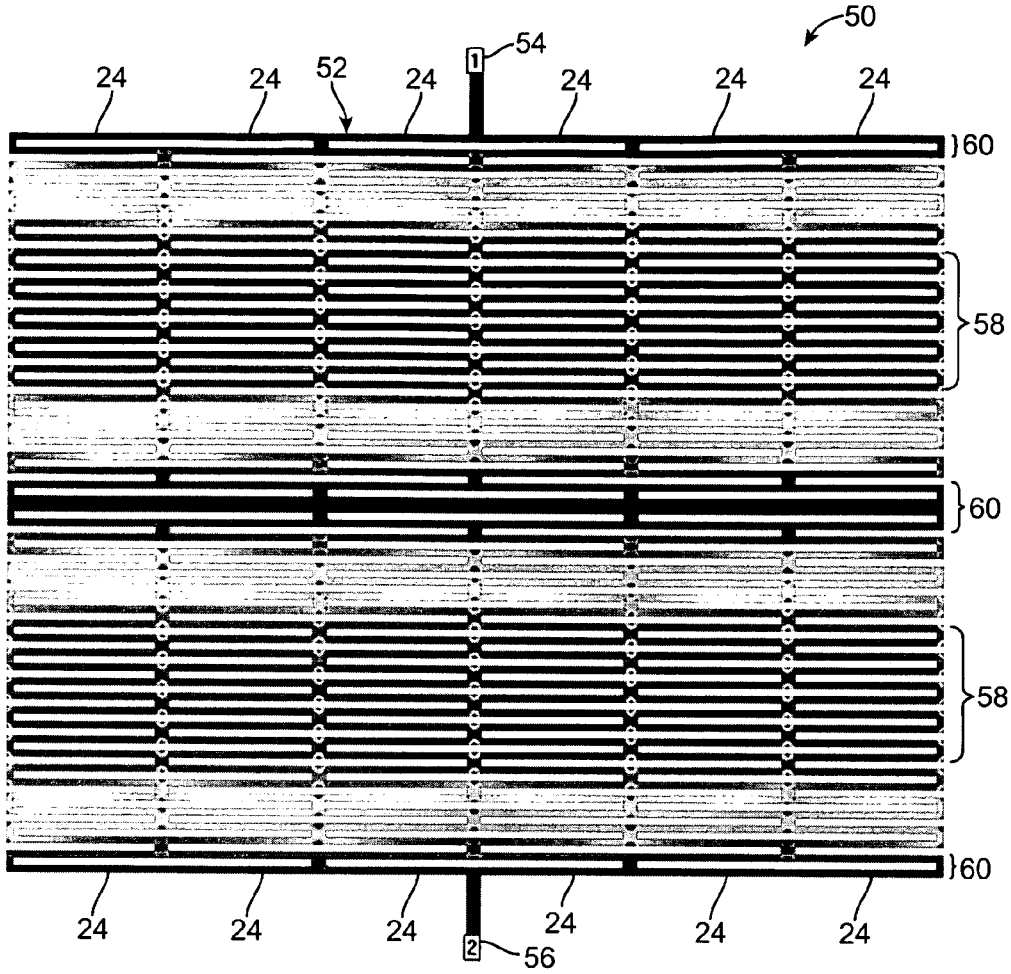
FIG. 7*a* is a plan view of a single-resonator, band-pass, microstrip filter constructed in accordance with the present inventions, wherein the measured electrical current distribution within the filter is particularly shown.

FIG. 7*a* illustrates a single-resonator, band-pass filter 50 comprising a resonator array 52 having twelve (n=12) of the basic zig-zag resonator structures 24 arranged as six columns coupled in parallel, with each column including two resonator structures 24 coupled in cascade, between an input terminal 54 and an output terminal 56. As can be seen, the filter 50 is similar to the filter 40 illustrated in FIG. 5, with the exception that the input and output terminals 54, 56 (which in this case had a resistance of 8,427 ohms each) are coupled to the opposites sites of the resonator array 52 to provide the filter 50 with band-pass characteristics, and in particular, at the top and bottom edges of the resonator array 52 between the innermost columns of resonator structures 24. Another distinction between filter 40 and filter 50 is that the connections between adjacent basic resonator structures 24 are now connected at more than just the top, bottom and midpoint of each resonator structure 24. In particular, a connection is made in filter 50 at every opportunity by butting each adjacent resonator structure 24 directly against its neighbor, thus further ensuring that unwanted modes are eliminated. Like the filter 40, the filter 50 should give an increase in power handling by a factor of twelve (10.7 dB) over that of a filter with a single basic resonator structure.

Figure 7B:
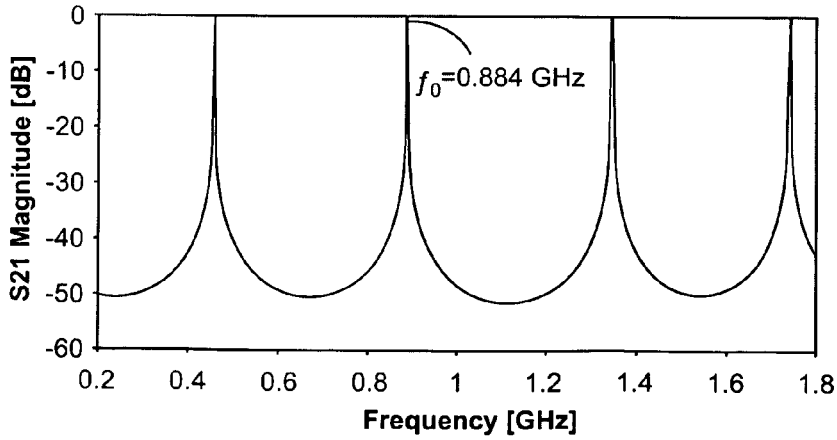
FIG. 7*b* is a plot of the computed frequency response of the filter of FIG. 7*a;*

Because the input and output terminals 54, 56 are coupled to the top and bottom edges of the resonator array 52, the two resonator structures 24 in each column are connected in cascade. As a result, the filter 50 has resonances equal to $f_0/2$ and multiples thereof. The computed frequency response of the filter 50, which plots the S21 power transmission in dB against the frequency in GHz, is shown in FIG. 7*b*. The fundamental resonant frequency $f_0$ of the filter 50 is shown to be 0.884 GHz.

The current density pattern of the band-pass filter 50 was computed at the fundamental resonant frequency $f_0$, and with a drive voltage of 1 volt and an external Q of 1000. As shown in FIG. 7*a*, regions of strong current density are represented by two medium dark gray bands 58, while regions of low current density are presented by three black bands 60. Sampling the current densities in the filter 50 indicated a maximum current density in the upper zig-zag resonator structures 24 adjacent to a vertical centerline of the resonator array 52 to be 32.0 A/m, and a maximum current density in the outermost left and right zig-zag resonator structures 24 of the filter 50 to be 32.7 A/m. As previously mentioned, this increase in peak density in the outermost zig-zag resonator structures 24 was observed in all of the filters. As also was found to be typical, the left and right zig-zag resonator structures 24 one column in from the outer edges have the same (or very nearly the same) maximum current density as do the zig-zag resonator structures 24 next to the vertical centerline.

Figure 8A:
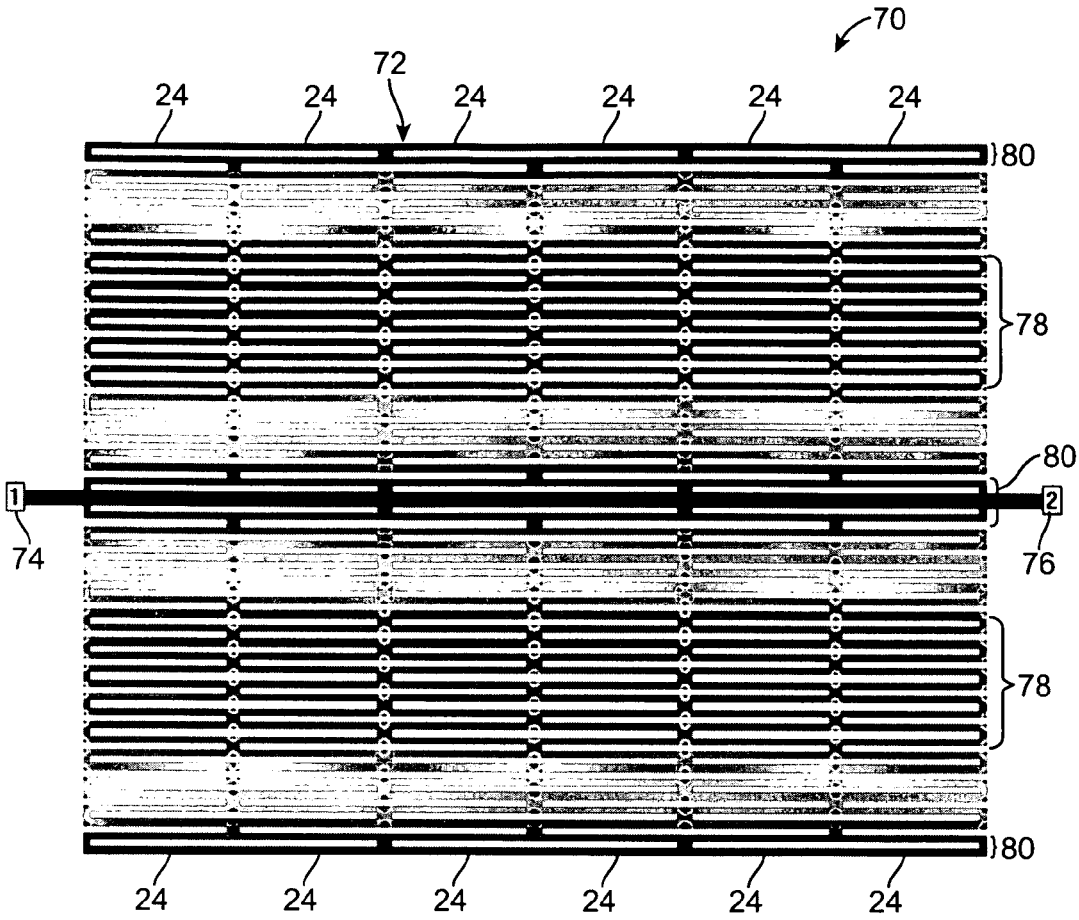
FIG. 8*a* is a plan view of another single-resonator, band-pass, microstrip filter constructed in accordance with the present inventions, wherein the measured electrical current distribution within the filter is particularly shown.

FIG. 8*a* illustrates a single-resonator, band-pass filter 70 comprising a resonator array 72 having twelve (n=12) of the basic zig-zag resonator structures 24 arranged as six columns of resonator structures 24, with each column including two resonator structures 24, coupled between an input terminal 74 and an output terminal 76. As can be seen, the filter 70 is similar to the filter 50 illustrated in FIG. 7*a* in that the input and output terminals 74, 76 (which in this case had a resistance of 7,600 ohms each) are coupled to opposite edges of the resonator array 72 to provide the filter 70 with band-pass characteristics. However, the filter 70 differs from the filter 50 in that, rather than being coupled to the top and bottom edges, the input and output terminals 74, 76 are coupled to the left and right edges of the resonator array 72 between the rows. Thus, the two resonator structures 24 in each column are connected in parallel, and thus, all twelve resonator structures 24 are connected in parallel. Like the filter 50, the filter 70 should give an increase in power handling by a factor of twelve (10.7 dB) over that of a filter with a single basic resonator structure.

Figure 8B:
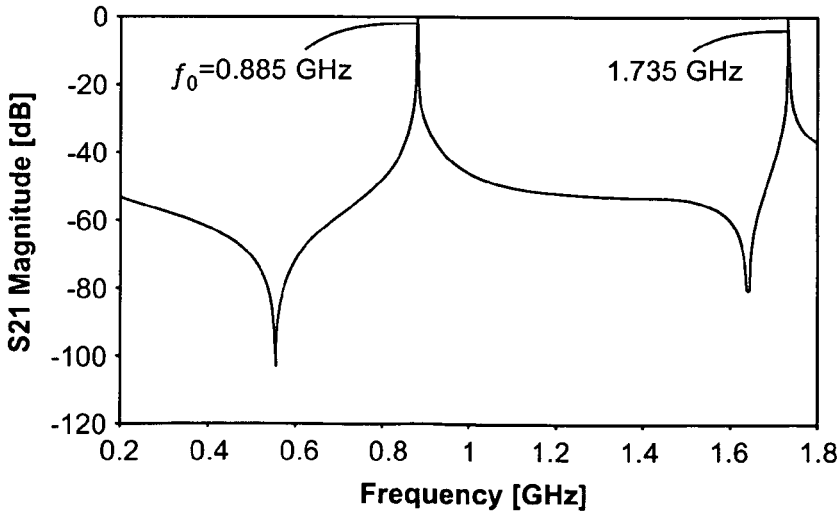
FIG. 8*b* is a plot of the computed frequency response of the filter of FIG. 8*a;*

The computed frequency response of the filter 70, which plots the S21 power transmission in dB against the frequency in GHz, is shown in FIG. 8*b*. The fundamental resonant fre uenc $f_0$ of the filter 70 is shown to be 0.885 GHz and the second order resonant frequency of the filter 70 is shown as 1.735 GHz. The filter 70 has all of the same modes as does the filter 50 in that the set of two resonator structures 24 in each column results in resonances at $f_0/2$ and multiples thereof. However, the center point of the left and right edges of the resonator array 72 happens to be a null point for the voltage in the mode at $f_0/2$. As a result, if the filter 70 is driven at these points, that mode will not be excited (which would otherwise be excited if the resonator structures 24 in each column were connected in cascade). Thus, because the lower-order modes do not arise in the frequency response as compared to the frequency response of the filter 50 illustrated in FIG. 7*b*, only pass-bands at the fundamental resonant frequency $f_0$ and multiples thereof will exist in the frequency response, as illustrated in FIG. 8*b*.

The current density pattern of the band-pass filter 70 was computed at the fundamental resonant frequency $f_0$, and with a drive voltage of 1 volt and an external Q of 1000. As shown in FIG. 8*a*, regions of strong current density are represented by two medium dark gray bands 78, while regions of low current density are presented by three black bands 80. In this case, the maximum current density in the interior zig-zag resonator structures 24 was 31.6 A/m, and the maximum current density in the zig-zag resonator structures 24 at the outer edges of the resonator array 72 was 32.7 A/m.

Figure 9A:
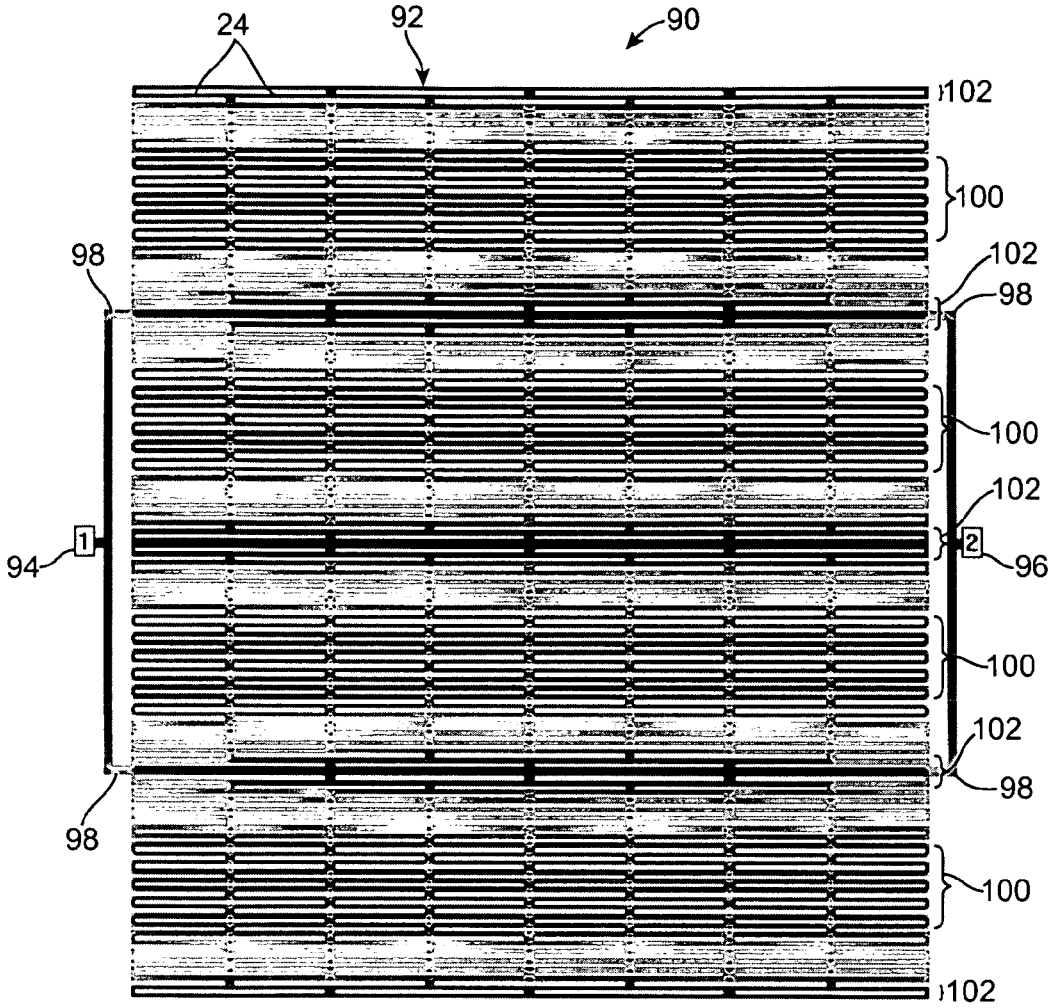
FIG. 9*a* is a plan view of still another single-resonator, band-pass, microstrip filter constructed in accordance with the present inventions, wherein the measured electrical current distribution within the filter is particularly shown.

FIG. 9*a* illustrates a single-resonator, band-pass filter 90 comprising a resonator array 92 having thirty-two (n=32) of the basic zig-zag resonator structures 24 arranged as eight columns of resonator structures 24, with each column including four resonator structures 24, coupled between an input terminal 94 and an output terminal 96. As can be seen, the filter 90 is similar to the filter 70 illustrated in FIG. 8*a* in that the input and output terminals 94, 96 (which in this case were 4,117 ohms) are coupled to left and right edges of the resonator array 92 to provide the filter 90 with band-pass characteristics. However, the filter 90 differs from the filter 70 in that the resonator array 92 includes two more rows of resonator structures 24, and each of the input and output terminals 94, 96 is coupled to the respective side of the resonator array 92 via double symmetric taps 98, one of which is connected to the array 92 between the first and second rows of resonator structures 24, and the other of which is connected between the third and fourth rows of resonator structures 24. Thus, the four resonator structures 24 in each column are connected in parallel, and thus, all thirty-two resonator structures 24 are connected in parallel. The filter 90 should give an increase in power handling by a factor of thirty-two (15 dB) over that of a filter with a single basic resonator structure.

Figure 9B:
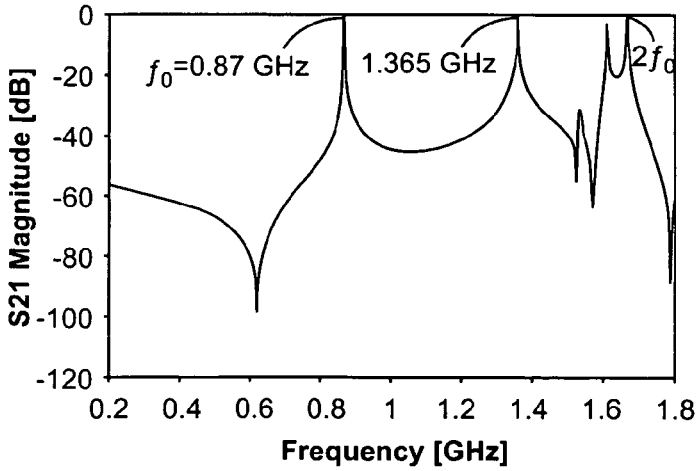
FIG. 9*b* is a plot of the computed frequency response of the filter of FIG. 9*a;*

The computed frequency response of the filter 90, which plots the S21 power transmission in dB against the frequency in GHz, is shown in FIG. 9*b*. The fundamental resonant frequency $f_0$ of the filter 90 is shown to be 0.87 GHz. The set of four resonator structures 24 in each column results in resonances at $f_0/4$ and multiples thereof. Now, at the $f_0/4$ resonance, the voltage pattern in the vertical direction is like a half cosine wave with a positive maximum at the top edge of the resonator array 92 and a negative maximum at the bottom edge of the resonator array 92. Since this voltage pattern is odd symmetric, while the voltage drive at the taps 98 is even symmetric, no excitation of this mode occurs. At the $f_0/2$ resonance, the tap points are zero-voltage points, so this mode will not couple, while for the $3f_0/4$ mode, the modal voltage is again odd-symmetric, so that taps with even-symmetric voltage will not couple. In this manner, the three lowest-order modes and the corresponding modes at image frequencies are eliminated from the frequency response. Thus, because the three lower-order modes do not arise in the frequency response, only pass-bands at the resonant frequency $f_0$ and multiples thereof (e.g., $2f_0$) will exist in the frequency response, as shown in FIG. 9*b*.

As further shown in FIG. 9*b*, the $2f_0$ resonance is split, and there is an added resonance at 1.365 GHz. It is believed that these effects are due to what is called "broad-structure modes," which move down in frequency as more columns of resonators are connected in parallel (i.e., as the width of the filter is increased). These modes also occur in the smaller filters that have been previously discussed, but at higher frequencies out of the range of interest. If more columns of resonator structures 24 are added to the filter 90 illustrated in FIG. 9*a*, the resonance at 1.365 GHz would move down in frequency. Thus, the existence of broad-structure modes becomes a limiting consideration as to how many columns of resonators can be connected in parallel within a filter. However, as will be seen from the next embodiment, by giving up the advantages of double side couplings and coupling at the top and bottom centers of the resonator array (i.e., not having all of the resonator structures 24 connected in parallel), this broad-structure mode limitation can be relaxed considerably.

The current density pattern of the band-pass filter 90 was computed at the fundamental resonant frequency $f_0$, and with a drive voltage of 1 volt and an external $Q_e$ of 1000. As shown in FIG. 9*a*, regions of strong current density are represented by four medium dark gray bands 100, while regions of low current density are presented by five black bands 102. In this case, the maximum current density in the interior zig-zag resonator structures 24 adjacent a vertical centerline at the top and bottom rows of the resonator array 92 were respectively 27.0 A/m and 27.3 A/m, while the maximum current density in the zig-zag resonator structures 24 at the outer edges of the resonator array 92 were respectively 27.8 A/m and 28.2 A/m. These current density values are somewhat smaller than the maximum current density values in the previously described filters. It is believed that this must be due to the non-zero length of the coupling lines used at the input and output of the filter.

Figure 10A:
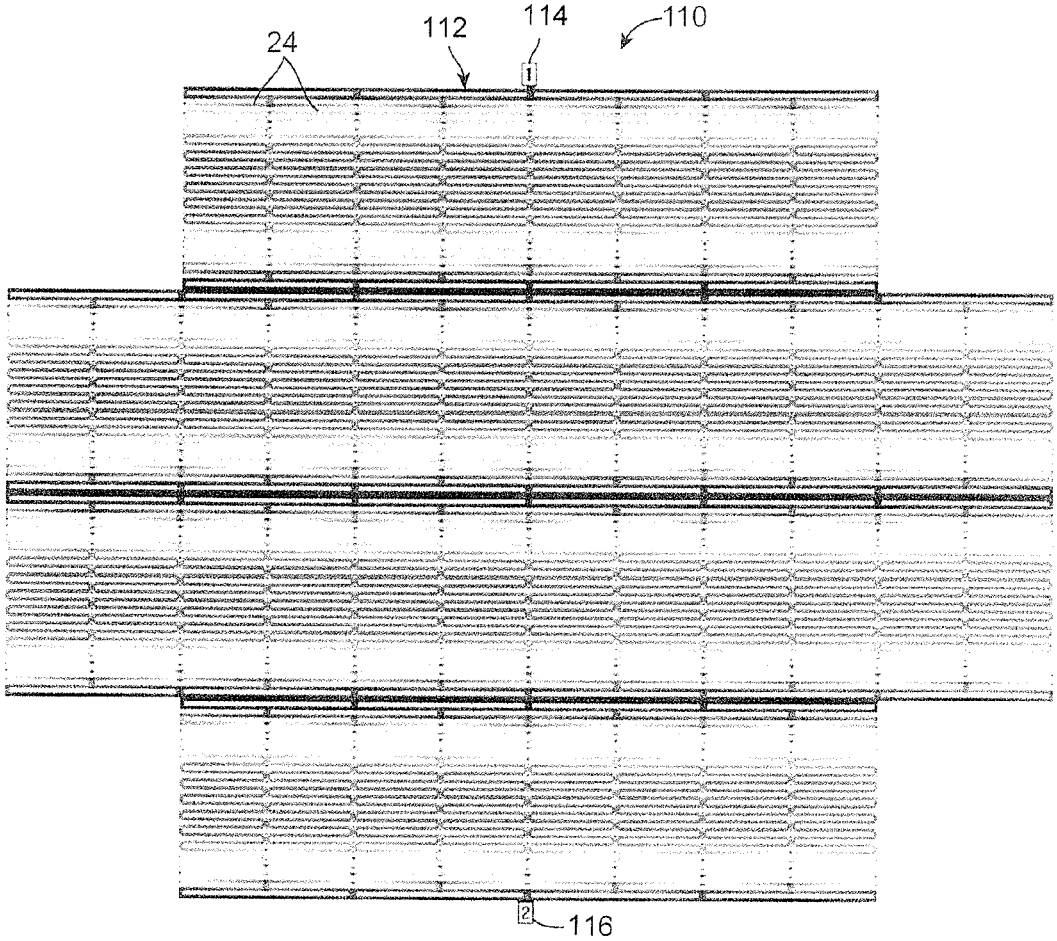
FIG. 10*a* is a plan view of yet another single-resonator, band-pass, microstrip filter constructed in accordance with the present inventions, wherein the measured electrical current distribution within the filter is particularly shown.

FIG. 10*a* illustrates a single-resonator, band-pass filter 110 comprising a resonator array 112 having forty (n=40) of the basic zig-zag resonator structures 24 arranged as twelve columns of resonator structures 24 coupled in parallel between an input terminal 114 and an output terminal 116. As can be seen, the filter 110 is similar to the filter 50 illustrated in FIG. 7*a* in that the input and output terminals 114, 116 are coupled to the top and bottom edges of the resonator array 112 between the innermost columns of resonator structures 24 to provide the filter 110 with band-pass characteristics. However, the filter 110 differs from the filter 50 in that it includes eight inner columns coupled in parallel between the input and output terminals 114, 116, each column of which includes four resonator structures 24 coupled in cascade between the input and output terminals 114, 116, and four outer columns coupled in parallel between the input and output terminals 114, 116, each of which includes two resonator structures 24 coupled in cascade between the input and output terminals 114, 116. That is, the filter 110 includes twelve columns coupled in parallel between the input and output terminals 114, 116 with four resonator structures 24 coupled in cascade between the input and output terminals 114, 116, except that two of the resonator structures 24 are removed from each of the corner of the resonator array 112. In this manner, the filter 110 more easily fits on a circular substrate, and in this case within a 56.9 mm (2.24 in) diameter circle. The filter 110 should give an increase in power handling by a factor of forty (16 dB) over that of a filter with a single basic resonator structure.

Figure 10B:
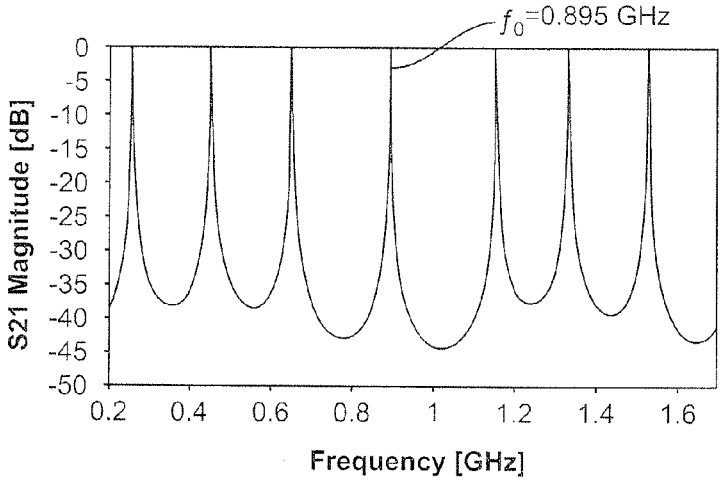
FIG. 10*b* is a plot of the computed frequency response of the filter of FIG. 10*a;*

The computed frequency response of the filter 110, which plots the S21 power transmission in dB against the frequency in GHz, is shown in FIG. 10*b*. The fundamental resonant frequency $f_0$ of the filter 110 is shown to be 0.895 GHz. If the resonator array 112 would have been excited at its left and right edges, a 12 column-wide, broad structure mode, which would have a resonance fairly close the fundamental resonant frequency $f_0$, would effectively be excited. However, because the resonator array 112 is instead being excited at the centers of its bottom and top edges, thereby effectively dividing the resonator array 112 into two halves connected in parallel, each of which has, at most, only six columns in parallel, the broad-structure modes will be well out of the frequency range of interest. Note that no broad-structure modes are evident in the frequency response of the filter 110, as shown in FIG. 10*b*. However, the resonator array 112 includes columns with as many as four resonator structures 24 connected in cascade, which will result in resonances at multiples of $f_0/4$ in the frequency response, as shown in FIG. 10*b*. If resonances this close to the fundamental frequency $f_0$ are acceptable for a given application, the filter 110 may be an acceptable choice.

Figure 11A:
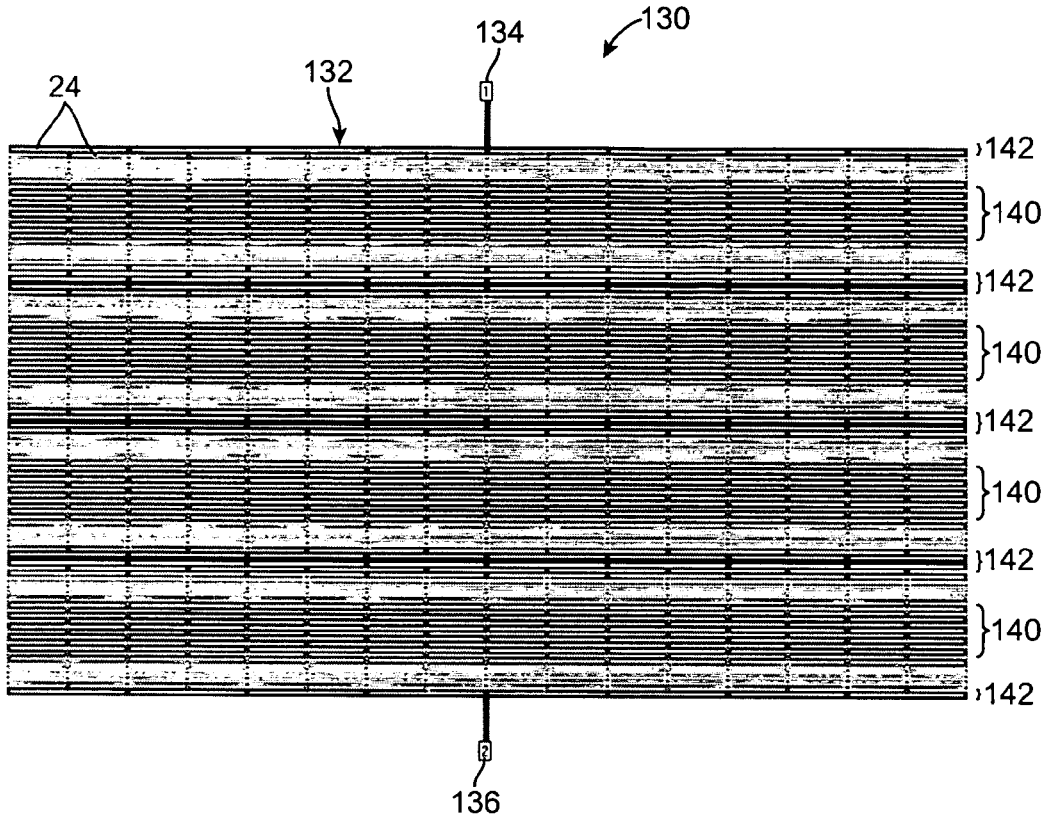
FIG. 11*a* is a plan view of yet another single-resonator, band-pass, microstrip filter constructed in accordance with the present inventions, wherein the measured electrical current distribution within the filter is particularly shown.

FIG. 11*a* illustrates a single-resonator, band-pass filter 130 comprising a resonator array 132 having sixty-four (n=64) of the basic zig-zag resonator structures 24 arranged as sixteen columns of resonator structures 24 coupled in parallel, with each column including four resonator structures 24 coupled in cascade, between an input terminal 134 and an output terminal 136. The resonator array 132 is 70.8 mm×41.0 mm (2.79 in×, 1.61 in).

As can be seen, the filter 130 is similar to the filter 50 illustrated in FIG. 7*a* in that the input and output terminals 134, 136 (which in this case had a resistance of 1,673 ohms each) are coupled to the top and bottom edges of the resonator array 132 between the innermost columns of resonator structures 24 to provide the filter 130 with band-pass characteristics. However, the filter 130 differs from the filter 50 in that it includes many more columns and rows of resonator structures 24, and in particular sixteen resonator structures 24. The filter 130 should give an increase in power handling by a factor of sixty-four (18 dB) over that of a filter with a single basic resonator structure.

Figure 11B:
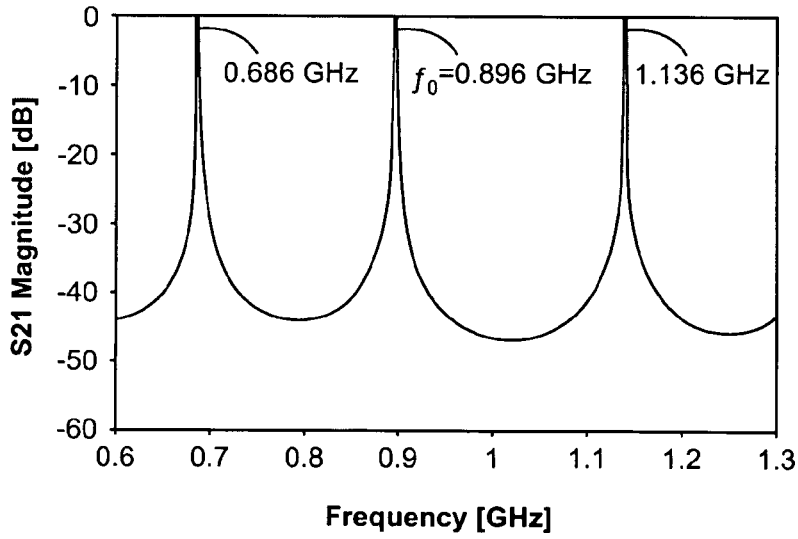
FIG. 11*b* is a plot of the computed frequency response of the filter of FIG. 11*a;*

The computed frequency response of the filter 130, which plots the S21 power transmission in dB against the frequency in GHz, is shown in FIG. 11*b*. The fundamental resonant frequency $f_0$ of the filter 110 is shown to be 0.896 GHz. Because the resonator array 132 is being excited at the centers of its bottom and top edges, thereby effectively dividing the resonator array 132 into two halves connected in parallel, each of which has, at most, only eight columns in parallel, the broad-structure modes will be well out of the frequency range of interest. Note that no broad-structure modes are evident in the frequency response of the filter 130, as shown in FIG. 11*b*. However, the resonator array 132 includes columns with four resonator structures 24 connected in cascade, which will result in resonances at multiples of $f_0/4$ in the frequency response (peaks at 0.686 GHz and 0.136 GHz), as shown in FIG. 11*b*. Again, if resonances this close to the fundamental resonant frequency $f_0$ are acceptable for a given application, the filter 130 may be an acceptable choice. It is possible that the as many as two more columns of resonator structures 24 can be added on each side of the resonator array 132 without having the broad-structure modes get as low as $5f_0/4$ (approximately the resonance on the right side of the frequency response in FIG. 11*b*. In this case, the power-handling of the filter 130 would be enhanced to eighty times (19 dB above) that of a filter with a single basic resonator structure.

The current density pattern of the band-pass filter 130 was computed at the fundamental resonant frequency $f_0$, and with a drive voltage of 1 volt and an external Q of 1000. As shown in FIG. 11*a*, regions of strong current density are represented by four medium dark gray bands 140, while regions of low current density are presented by five black bands 142. In this case, the maximum current density in the interior zig-zag resonator structures 24 adjacent a vertical centerline at the top and bottom rows of the resonator array 132 were respectively 31.0 A/m in both rows, while the maximum current density in the zig-zag resonator structures 24 at the outer left and right edges of the resonator array 132 were respectively 31.7 A/m and 31.9 A/m.

Figure 12:
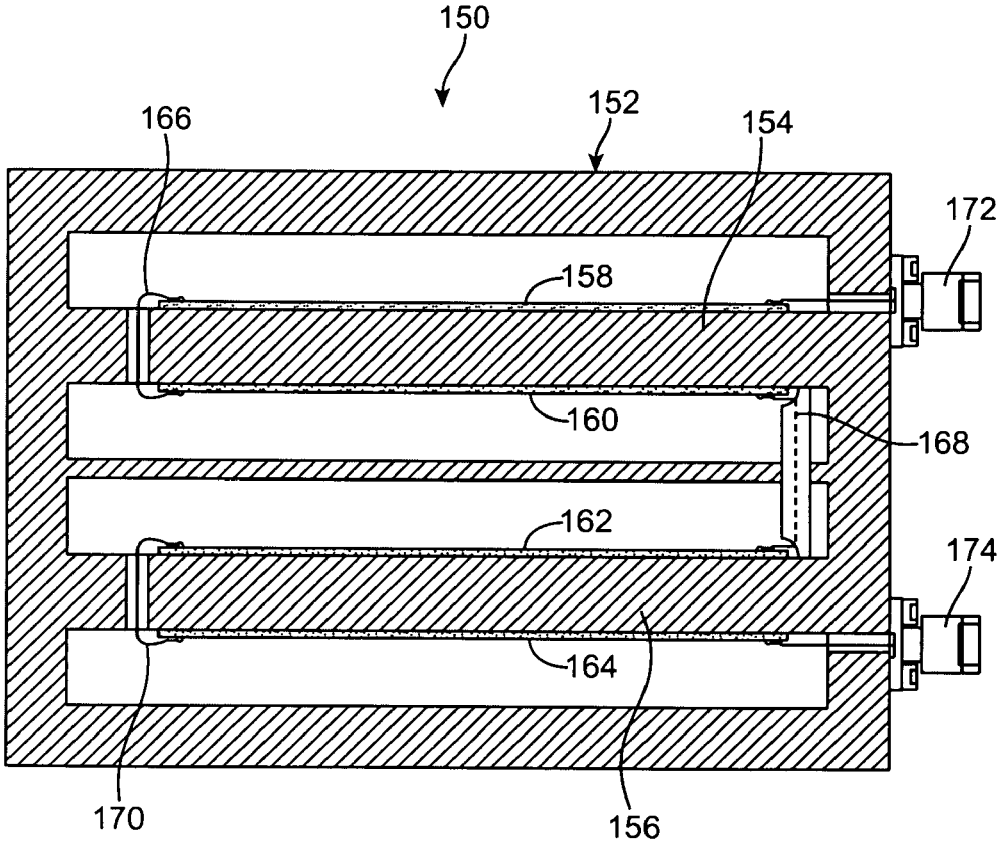
FIG. 12 is a cross-sectional view of an embodiment of a four-resonator filter constructed in accordance with the present inventions.

It is apparent that multi-resonator filters using large resonator arrays, as in some of the preceding embodiments, would need to have the resonator arrays placed on separate substrates. We have previously demonstrated a similar approach for low frequency HTS filters, described in Mossman et. al. "A narrow-band HTS bandpass filter at 18.5 MHz" Proc. IEEE Microwave Theories and Techniques Symposium, 653-656(2000). For example, FIG. 12 illustrates a filter 150, which comprises a conventional housing 152 having a pair of upper and lower, relatively thick, parallel, metal plates 154, 156 that act as both supports and heat-sinks, and four resonators 158, 160, 162, and 164 in a stacked configuration, with the resonators 158, 160 being disposed on the respective upper and lower surfaces of the upper metal plate 154, and the resonators 162, 164 being disposed on the respective upper and lower surfaces of the lower plate 156. Each of the resonators 158 may take the form of any of the previously described resonators. The capacitive couplings (not shown) may be realized on the substrates or provided using chip capacitors.

The filter 150 further comprises an electrically conductive coupling 166 coupled between the two resonators 158, 160, an electrically conductive coupling 168 coupled between the two resonators 160, 162, and an electrically conductive coupling 170 coupled between the two resonators 162, 164, such that all of the resonators 158-164 are coupled in cascade. The filter 150 further comprises an input connector 172 mounted to the housing 152 in communication with the resonator 158, and an output connector 174 mounted to the housing 152 in communication with the resonator 164.

The filter 150 may optionally comprise a relatively thin plate (not shown) for isolation between the resonators 158, although this may not be necessary if the basic resonator structures used in the resonators 158 are zig-zag structures, which tend to keep the fields relatively close to the substrates.

It is of interest to note that in typical, multi-resonator, band-pass filter designs, the largest voltages and currents occur in the interior resonators, while the voltages and currents may be considerably less in the outer resonators. Thus, it might be feasible to use smaller resonator arrays with different spurious response characteristics at the ends of a filter, and thus, suppress some spurious responses. In this regard, it might be optimum for the outer resonators to have dissimilar characteristics in order to avoid the possibility of a spurious pass-band if there is a resonance in the interior resonators with a transmission phase length of $\pi$ or a multiple thereof, while the outer two resonators acts as equal coupling discontinuities.

Figure 13A:
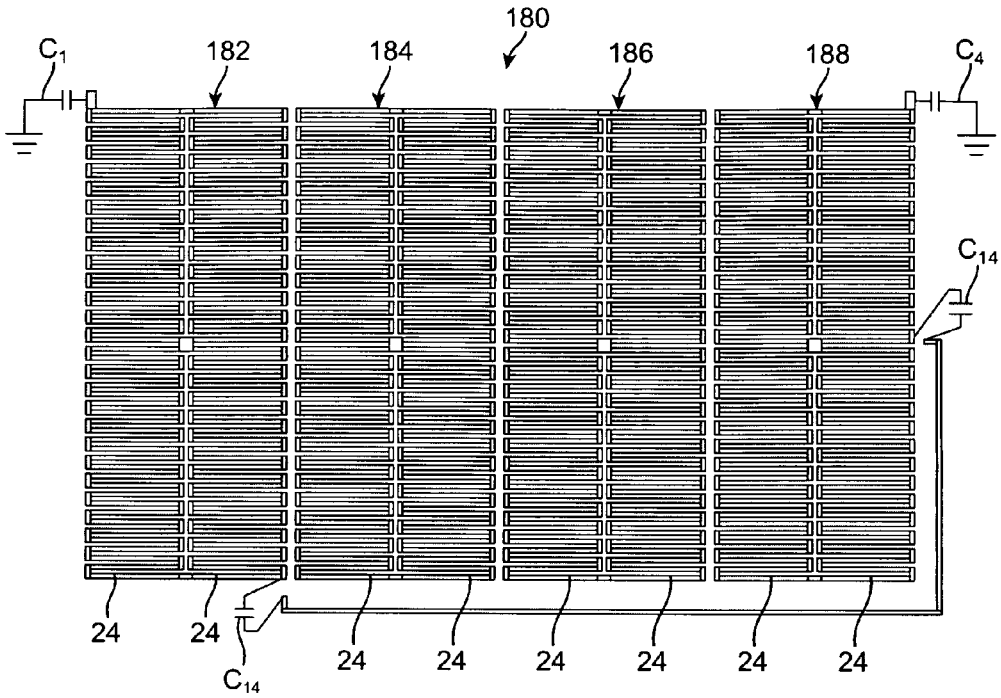
FIG. 13*a* is a plan view of another embodiment of a four-resonator filter constructed in accordance with the present inventions.

In some cases, only a modest increase in power handling may be needed, so that the resonators need not be very large. Then, it may be feasible to put the entire filter on a single substrate. For example, FIG. 13*a* illustrates a filter 180 comprising four resonators 182, 184, 186, and 188, each of which comprises four basic zig-zag resonator structures 24 arranged in two columns coupled in parallel, with each column comprising two resonator structures 24 coupled in cascade. This should give an increase in power handling by a factor of four (6 dB) for each resonator over that of a single basic resonator structure. The overall dimensions of the filter 180 is 36.6 mm×20.7 mm (1.44 in ×, 0.81 in).

Figure 13B:
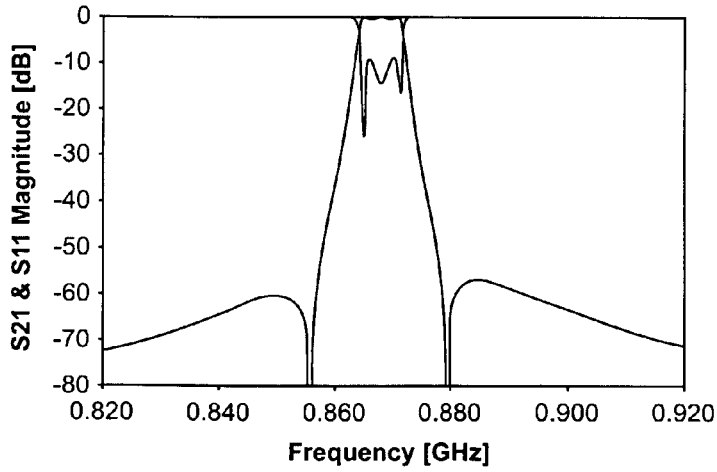
FIG. 13*b* is a plot of the computed frequency response of the filter of FIG. 13*a*.

The filter 180 has terminations having resistances of 1600 ohms. The filter 180 further comprises coupling capacitors $C_{14}$ coupled between the bottom of the first resonator 182 and the middle of the fourth resonator 188. In order to bring the first and fourth resonators 182, 188 into proper tuning, the filter 180 also comprises a capacitor $C_1$ coupled between the top of the first resonator 182 and ground, and a capacitor $C_4$ coupled between the top of the fourth resonator 188 and ground. Each of the coupling capacitors $C_{14}$ has a value of 0.10 pf, and each of the capacitors $C_1$, $C_4$ has a value of −0.046 (to be realized by trimming the resonator). It is interesting to note that the sign of the capacitive coupling between the first and fourth resonators 182, 188 could have been reversed by simply making the connection to the fourth resonator 188 at its bottom instead of at its middle. As can be appreciated, the coupling between the resonators 182-188 is achieved simply by their proximity to each other. The computed frequency response of the filter 180, which plots the S21 and S11 power transmission in dB against the frequency in GHz, is shown in FIG. 13*b*. The equal-ripple fractional bandwidth of the pass-band is about 0.81 percent.

As evidenced by the foregoing, the principles of increasing the power handling of a transmission-line resonator by forming it from an array of smaller transmission-line resonators were explored and successfully confirmed by computations and experiments. The results are quite encouraging, particularly in that the current densities computed at the fundamental resonance frequency in quite large arrays appear to be remarkably uniformly periodic. It was seen that, as far as power handling is concerned, there is no special advantage in using one set of connections over the other (i.e., parallel versus cascade). Regardless of the connections used, the power handling is increased by a factor equal to the number of basic resonator structures used.

Usually, it will be advantageous to use both types of connections in order to minimize the influence of unwanted modes. The basic sources of the unwanted modes are: the harmonic responses of the basic resonator structures, the additional harmonic responses that occur when the basic resonator structures are connected in cascade, and the broad-structure modes that may move down into the frequency range of interest when a sizable number of basic resonator structures are connected in parallel, so that a broad-structure standing wave can occur across the overall width of the array. The more basic resonator structures that are connected in parallel, the lower the first resonance of these broad-structure modes will be.

When employing the zig-zag resonator structure used in this study, if the spurious mode requirements are not too severe, it might be possible to use as many as 9 (or perhaps 10) basic resonator structures in parallel. But this could be increased by a factor of 18 or 20 by using two sets of 9 or 10 basic resonator structures driven in parallel by taps at the top and bottom centers of the array. If the largest array practical for given spurious response requirements is to be used, both the harmonic and broad-structure modes should be analyzed in order to decide on the maximum allowable number of basic resonator structures in cascade in each column of the array and the maximum allowable number of columns in parallel.

It is easily seen that at the resonances for the various modes that are harmonically related to the fundamental resonant frequency $f_0$, the voltage variations are periodic in the vertical direction (as shown in the figures), with alternating positive and negative maximum magnitudes, zero values in between, and with positive or negative maxima at the top and bottom of the array. Further, it is seen that these voltage patterns alternate between odd and even symmetry as the modes increase in order. In the filter 90 of FIGS. 9*a* and 9*b*, which has four basic zig-zag resonator structures in cascade in each column, it was demonstrated that it is possible to take advantage of these properties by using pairs of taps on each side of the array located at zero-voltage points for the $f_0/2$ mode. This mode is then not coupled, because it is being driven at a zero-voltage point, while the $f_0/4$ and $3f_0/4$ modes do not couple, because the voltage excitation is even symmetric while the modal voltage required is odd symmetric. This, then, is seen as a way of eliminating the three, lowest-order resonances and their harmonics. Unfortunately, if this technique for reducing the number of harmonic modes is used, the technique of driving the left and right halves of the resonator array in parallel cannot be used so as to move the broad-structure modes up in frequency. This is because the former requires driving the resonator array at its sides while the latter requires driving the structure at its top and bottom.

It is seen that the use of zig-zag structures as the basic resonator is an important feature for ensuring a high unloaded Q for the filters. This is due to the fact that the zig-zag resonator structures cause the fields to be confined to relatively close to the substrate even if the overall structure becomes quite large in extent. Thus, even through the resonator array was, in some cases, quite large, there was no evidence of the excitation of modes strongly influenced by the housing dimensions. Also, the fact that the measured unloaded Q's for the test filters were as high as 151,000 when operating at 77° K and as high as 240,000 when operating at 60° K indicates that the fields are not impinging significantly on the normal-metal walls of the housing, which would otherwise drastically reduce the unloaded Q.

It can be appreciated that the techniques described herein should also provide means for obtaining compact filters with moderately increased power handling without being forced to resort to the use of disk resonators that might be quite large. The very high Q of these zig-zag resonator structures and their reasonably good control of spurious responses may result in relatively high-power filters with very sharp cutoffs that can meet some extremely demanding requirements.

Although particular embodiments of the present invention have been shown and described, it should be understood that the above discussion is not intended to limit the present invention to these embodiments. It will be obvious to those skilled in the art that various changes and modifications may be made without departing from the spirit and scope of the present invention. For example, the present invention has applications well beyond filters with a single input and output, and particular embodiments of the present invention may be used to form duplexers, multiplexers, channelizers, reactive switches, etc., where low-loss selective circuits may be used. Thus, the present invention is intended to cover alternatives, modifications, and equivalents that may fall within the spirit and scope of the present invention as defined by the claims.

What is claimed is:

1. A narrowband filter, comprising:

an input terminal;

an output terminal; and an array of basic folded resonator structures coupled between the input terminal and the output terminal to form a single resonator, wherein each of the basic resonator structures and the single resonator have the same resonant frequency.

2. The filter of claim 1, wherein each of the basic folded resonator structures is a planar structure.

3. The filter of claim 1, wherein each of the basic folded resonator structures is a microstrip structure.

4. The filter of claim 1, wherein each of the basic folded resonator structures is composed of high temperature superconductor (HTS) material.

5. The filter of claim 1, wherein each of the basic folded resonator structures has a nominal linear electrical length of a half wavelength at the resonant frequency.

6. The filter of claim 1, wherein the resonant frequency is in the microwave range.

7. The filter of claim 6, wherein the resonant frequency is in the range of 800-2,200 MHz.

8. The filter of claim 1, wherein the single resonator has an unloaded Q of at least 100,000.

9. The filter of claim 1, wherein each of the basic folded resonator structures is a zig-zag structure.

10. The filter of claim 1, further comprising an electrically conductive element coupled between at least two of the basic folded resonator structures.

11. The filter of claim 1, wherein the array of basic folded resonator structures is coupled between the input terminal and the output terminal in a manner that characterizes the filter as a band-stop filter.

12. The filter of claim 1, wherein the array of basic folded resonator structures is coupled between the input terminal and the output terminal in a manner that characterizes the filter as a band-pass filter.

13. The filter of claim 1, wherein the array of basic folded resonator structures are coupled in parallel between the input terminal and the output terminal.

14. The filter of claim 13, wherein the array of basic folded resonator structures comprises at least three basic resonator structures, and at least two of the basic folded resonator structures are coupled between the input terminal and the output terminal in cascade.

15. The filter of claim 1, wherein the array of basic folded resonator structures comprises a plurality of columns of basic resonator structures, each column of basic resonator structures having at least two basic resonator structures.

16. The filter of claim 15, wherein the columns of basic folded resonator structures are coupled between the input terminal and the output terminal in parallel.

17. The filter of claim 16, wherein the at least two basic folded resonator structures in each column of basic folded resonator structures is coupled between the input terminal and the output terminal in parallel.

18. The filter of claim 16, wherein the at least two basic folded resonator structures in each column of basic folded resonator structures is coupled between the input terminal and the output terminal in cascade.

19. The filter of claim 1, wherein the array of basic folded resonator structures is arranged in a plurality of columns and a plurality of rows, where each of the basic folded resonator structures has a direction of energy propagation that is aligned with the plurality of columns.

20. The filter of claim 19, wherein the input and output terminals are coupled to the array of basic folded resonator structures between a first pair of immediately adjacent rows.

21. The filter of claim 20, wherein the input and output terminals are also coupled to the array of basic folded resonator structures between a second pair of immediately adjacent rows.

22. The filter of claim 19, wherein the input and output terminals are coupled to the array of basic folded resonator structures between a pair of immediately adjacent columns.

23. The filter of claim 1, further comprising another array of basic folded resonator structures coupled between the input terminal and the output terminal in parallel to form another single resonator having the resonant frequency.

* * * * *